US008270872B2

(12) United States Patent
Takiguchi et al.

(10) Patent No.: US 8,270,872 B2
(45) Date of Patent: Sep. 18, 2012

(54) IMAGE FORMING APPARATUS HAVING A CONNECTING MECHANISM BETWEEN PHOTORECEPTOR ASSEMBLY AND DEVELOPING ASSEMBLY

(75) Inventors: Toshio Takiguchi, Saitama (JP); Takuji Matsumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 454 days.

(21) Appl. No.: 12/557,151

(22) Filed: Sep. 10, 2009

(65) Prior Publication Data

US 2010/0209137 A1 Aug. 19, 2010

(30) Foreign Application Priority Data

Feb. 17, 2009 (JP) ..... P2009-034200

(51) Int. Cl.
*G03G 21/18* (2006.01)

(52) U.S. Cl. ..... 399/114

(58) Field of Classification Search ..... 399/102, 399/103, 105, 106, 111, 113, 114
See application file for complete search history.

(56) References Cited

U.S. PATENT DOCUMENTS

| | | | | |
|---|---|---|---|---|
| 4,766,455 | A * | 8/1988 | Carter | 399/116 |
| 6,993,267 | B2 * | 1/2006 | Yoshiyuki et al. | 399/114 |
| 7,532,841 | B2 * | 5/2009 | Tanaka | 399/114 |
| 7,929,881 | B2 * | 4/2011 | Yoshino et al. | 399/113 |
| 8,055,154 | B2 * | 11/2011 | Iikura et al. | 399/111 |
| 8,095,036 | B2 * | 1/2012 | Yoshino et al. | 399/114 |
| 2004/0190936 | A1 | 9/2004 | Yoshiyuki et al. | |
| 2005/0123319 | A1 | 6/2005 | Mizoguchi | 399/111 |
| 2007/0206971 | A1 | 9/2007 | Yoshino | 399/111 |

FOREIGN PATENT DOCUMENTS

| | | |
|---|---|---|
| JP | 1-85734 | 6/1989 |
| JP | 2-244075 | 9/1990 |
| JP | 04-046355 | 2/1992 |
| JP | 04-066961 | 3/1992 |
| JP | 04-110975 | 4/1992 |
| JP | 5-232752 | 9/1993 |
| JP | 6-35247 | 2/1994 |
| JP | 09-127851 | 5/1997 |
| JP | 10-186851 | 7/1998 |

(Continued)

OTHER PUBLICATIONS

Japanese Office Action dated Jun. 7, 2011.

*Primary Examiner* — Robert Beatty
(74) *Attorney, Agent, or Firm* — Sughrue Mion, PLLC

(57) ABSTRACT

An image forming assembly includes a photoreceptor assembly that includes a photoreceptor, and an accommodating container that accommodates at least the photoreceptor and holds the photoreceptor with a part of the photoreceptor being exposed; a developing assembly that includes a developing member, and a developer container that accommodates at least the developer member and holds the developing member so as to position the developing member at a portion opposed to the photoreceptor; a connecting mechanism that connects the photoreceptor assembly to the developing assembly so that a distance between the photoreceptor and the developing member is changeable; a protection member that covers and protects the exposed portion of the photoreceptor; and guide members that are respectively provided on the accommodating container and the developer container, and that detachably guide the protection member with the protection member lying astride the two assemblies.

14 Claims, 27 Drawing Sheets

FOREIGN PATENT DOCUMENTS

| | | | |
|---|---|---|---|
| JP | 2000-181328 | | 6/2000 |
| JP | 2000181326 | A * | 6/2000 |
| JP | 2000-258979 | | 9/2000 |
| JP | 2001-282079 | | 10/2001 |
| JP | 2002-182541 | | 6/2002 |
| JP | 2003-173076 | | 6/2003 |
| JP | 2003-195614 | | 7/2003 |
| JP | 2004-170904 | | 6/2004 |
| JP | 2004-280012 | | 10/2004 |
| JP | 2005-141140 | | 6/2005 |
| JP | 2007-233240 | | 9/2007 |
| JP | 2008-015022 | | 1/2008 |
| JP | 2008-170950 | | 7/2008 |

* cited by examiner

IMAGE FORMING APPARATUS HAVING A CONNECTING MECHANISM BETWEEN PHOTORECEPTOR ASSEMBLY AND DEVELOPING ASSEMBLY

CROSS-REFERENCE TO RELATED APPLICATIONS

This application is based on and claims priority under 35 USC 119 from Japanese Patent Application No. 2009-034200 filed on Feb. 17, 2009.

BACKGROUND

Technical Field

The present invention relates to an image forming assembly and an image forming apparatus using the same.

SUMMARY

According to an aspect of the invention, there is provided an image forming assembly, which is detachably mounted on a receiving section provided beforehand in a housing of an image forming apparatus and forms an image on a transfer medium, the image forming assembly including: a photoreceptor assembly that includes: a photoreceptor, and an accommodating container that accommodates at least the photoreceptor and holds the photoreceptor with a part of the photoreceptor being exposed; a developing assembly that includes: a developing member, and a developer container that accommodates at least the developer member and holds the developing member so as to position the developing member at a portion opposed to the photoreceptor; a connecting mechanism that connects the photoreceptor assembly to the developing assembly so that a distance between the photoreceptor and the developing member is changeable; a protection member that covers and protects the exposed portion of the photoreceptor; and guide members that are respectively provided on the accommodating container and the developer container, and that detachably guide the protection member with the protection member lying astride the two assemblies.

BRIEF DESCRIPTION OF THE DRAWINGS

Exemplary embodiment(s) of the present invention will be described in detail based on the following figures, wherein:

FIG. 26B is an explanatory view showing the action of the constraint-releasing mechanism of the protection cover shown in FIG. 26A, wherein

1 denotes Image forming assembly, 2 denotes Photoreceptor assembly, 3 denotes Accommodating container, 4 denotes Photoreceptor, 5 denotes Charger, 6 denotes Cleaner, 7 denotes Neutralizing unit, 10 denotes Developing assembly, 11 denotes Developer container, 11*a* denotes Developer accommodating chamber, 11*b* denotes Initial developer storing chamber, 12 denotes Developing member, 13 denotes Developer stirring member, 14 denotes Connecting mechanism, 15 denotes Protection member, 16 (16*a* and 16*b*) denote Guide members, 17 denotes Constraining mechanism, 18 (18*a* and 18*b*) denotes Hermetic sealing members, 19 denotes Constraint-releasing mechanism, W denotes Housing of image forming apparatus, and U denotes Receiving section of assembly

DETAILED DESCRIPTION

General Description of Exemplary Embodiment

First, a general description of an exemplary embodiment of an image forming apparatus to which the present invention is applied will be given below referring to FIGS. 1 and 2.

Figure 1A:
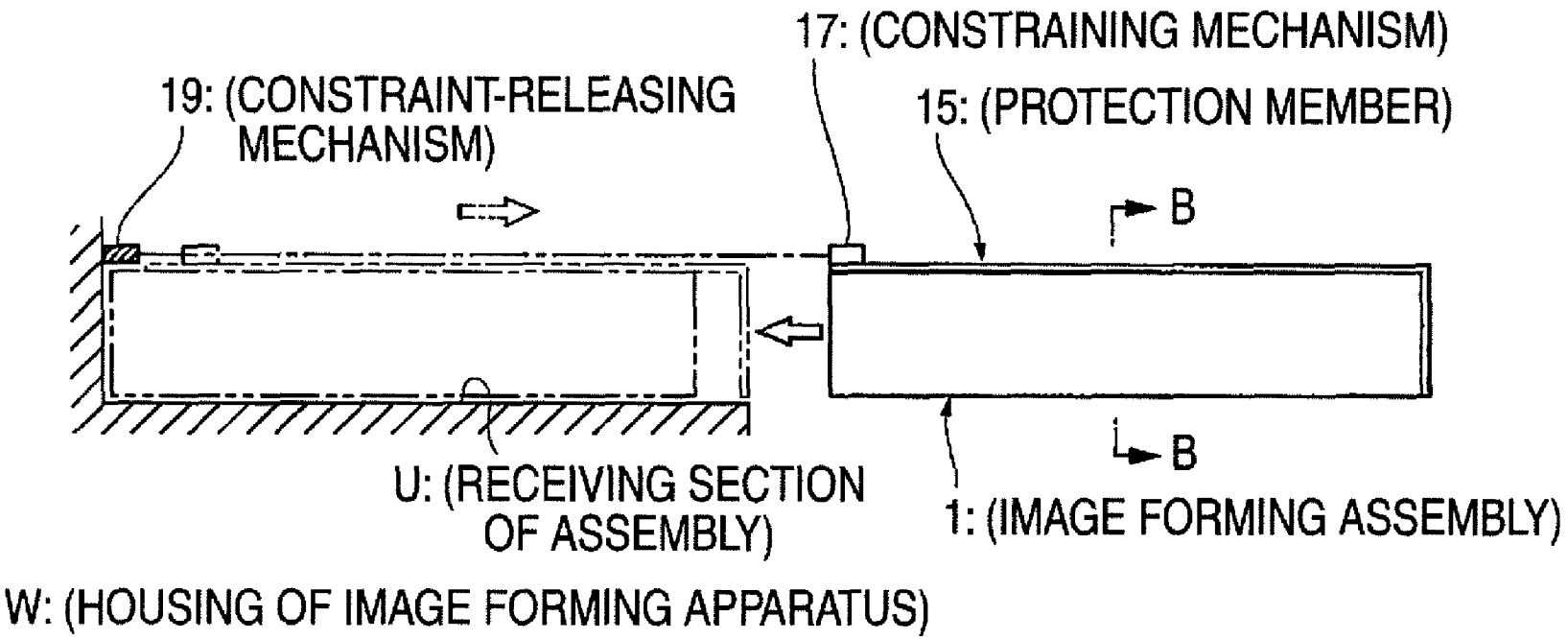
FIG. 1A is an explanatory view showing the outline of an exemplary embodiment of an image forming apparatus to which the present invention is applied.

In this exemplary embodiment, the image forming apparatus includes, as shown in FIG. 1A, an assembly receiving section U provided beforehand in the housing W of the image forming apparatus and an image forming assembly 1 detachably mounted on this assembly receiving section U.

Figure 1B:
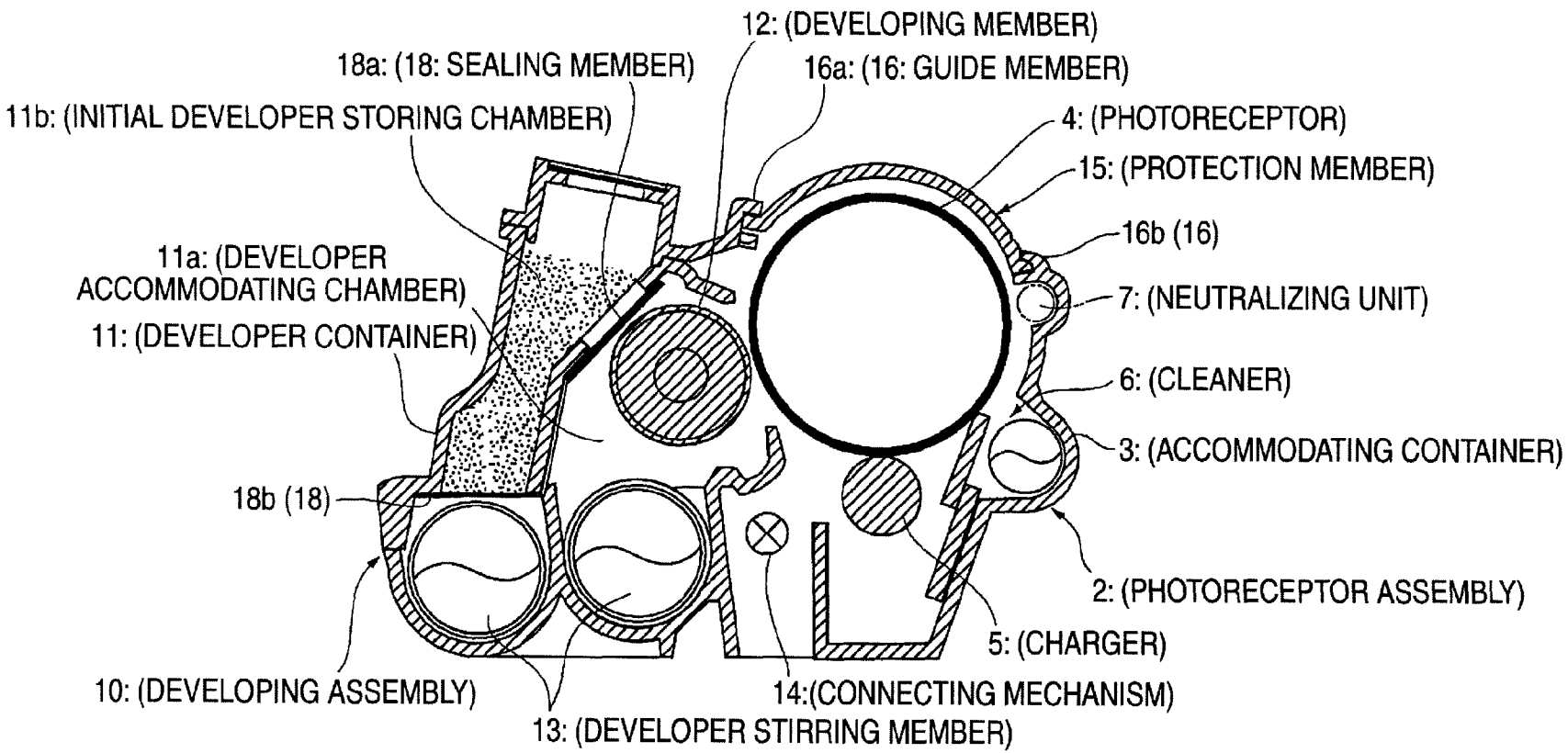
FIG. 1B is a sectional view taken on line B-B of FIG. 1A.

As shown in FIG. 1B, the image forming assembly 1 being used in the exemplary embodiment includes a photoreceptor assembly 2 in which at least a photoreceptor 4 is accommodated in an accommodating container 3 and the photoreceptor 4 is held in the accommodating container 3 while part thereof is exposed; a developing assembly 10 in which at least a developing member 12 is accommodated in a developer container 11 and the developing member 12 is held in the developer container 11 so that the developing member 12 is positioned at a portion opposed to the photoreceptor 4 of the photoreceptor assembly 2; a connecting mechanism 14 for connecting the photoreceptor assembly 2 to the developing assembly 10 so that the distance between the photoreceptor 4 of the photoreceptor assembly 2 and the developing member 12 of the developing assembly 10 is changeable; a protection member 15 for protecting the exposed portion of the photoreceptor 4 of the photoreceptor assembly 2 so as to cover the exposed portion; and guide members 16 (more specifically, 16*a* and 16*b*) respectively provided on the accommodating container 3 of the photoreceptor assembly 2 and the developer container 11 of the developing assembly 10, for detachably guiding the protection member 15 while the protection member 15 is lying astride the two assemblies 2 and 10.

With this kind of technical structure, the image forming assembly 1 is used to form images on transfer media. The transfer media herein include not only recording media but also, for example, intermediate transfer members for intermediately transferring and holding images before the images are transferred to recording media.

The image forming assembly 1 is configured so that the photoreceptor assembly 2 and the developing assembly 10 are movably connected to each other via the connecting mechanism 14

In addition, the photoreceptor assembly 2 includes not only a mode in which the photoreceptor 4 is accommodated in the accommodating container 3 as a matter of course, but also a mode in which, in addition to the photoreceptor 4, all or some of a charger 5 for charging the photoreceptor 4, a cleaner 6 for cleaning the surface of the photoreceptor 4 and a neutralizing unit 7 for removing the charge remaining on the photoreceptor 4 are accommodated.

Furthermore, the developing assembly 10 includes not only a mode in which the developing member 12, such as a developer holding member, is accommodated in the developer container 11 as a matter of course, but also a mode in which, in addition to the developing member 12, other functional members, such as a developer stirring member 13 for stirring and conveying developer inside the developer container 11 and a developer layer thickness restricting member (not shown) for restricting the thickness of the developer layer held in the developing member 12.

Moreover, the connecting mechanism 14 should only be a mechanism for connecting the two assemblies 2 and 10 so that the distance between the photoreceptor 4 and the developing member 12 is changeable. A typical example of the mechanism may include a mechanism for rockably supporting the two assemblies.

Besides, it is preferable that the protection member 15 should cover the exposed portion of the photoreceptor 4 in a non-contact state. However, if the protection member 15 is made of a soft material so as not to damage the photoreceptor 4, the protection member 15 may be disposed so as to make contact with the exposed portion of the photoreceptor 4.

Still further, the guide members 16 (more specifically, 16*a* and 16*b*) should only be provided on the accommodating container 3 of the photoreceptor assembly 2 and the developer container 11 of the developing assembly 10, respectively, so as to detachably guide the protection member 15.

In addition, a preferable example of the guide members 16 for guiding the protection member 15 may include guide members provided on the accommodating container 3 of the photoreceptor assembly 2 and the developer container 11 of the developing assembly 10, extending in the attaching/detaching direction of the image forming assembly 1 and slidably guiding the protection member 15.

Furthermore, from the viewpoint of preventing the photoreceptor 4 and peripheral components around the protection member 15 from being damaged, it is preferable that the protection member 15 should be extractably moved in one direction of the guide members 16.

Moreover, from the viewpoint of avoiding a situation in which the protection member 15 is moved unnecessarily when the image forming assembly 1 is stored or conveyed, it is preferable that the image forming assembly includes a constraining mechanism 17 for constraining the movement of the protection member 15 with respect to the guide members 16.

Besides, from the viewpoint of maintaining the positional relationship between the photoreceptor 4 and the developing member 12 constant when the image forming assembly 1 is mounted, it is preferable that the image forming assembly includes a position adjusting member (not shown) for maintaining the positional relationship between the developing member 12 of the developing assembly 10 and the photoreceptor 4 of the photoreceptor assembly 2 constant.

Still further, even in a mode in which the developing member 12 is equipped with the position adjusting member, since the protection member 15 is provided so as to be lying astride the accommodating container 3 of the photoreceptor assembly 2 and the developer container 11 of the developing assembly 10, the positional relationship between the two assemblies 2 and 10 at the time when the image forming assembly 1 is not mounted is restricted by the protection member 15. Hence, there is no fear that the position adjusting member may collide with the photoreceptor 4 unnecessarily.

What's more, from the viewpoint of effectively avoiding the developing member 12 of the developing assembly 10 and the photoreceptor 4 of the photoreceptor assembly 2 from being damaged, it is preferable that the distance between the developing member 12 of the developing assembly 10 and the photoreceptor 4 of the photoreceptor assembly 2 should be maintained in a direction that the two are away from each other when the protection member 15 is in a constrained state.

In addition, as a typical mode of the developing assembly 10, the developing assembly 10 has a developer accommodating chamber 11*a* for accommodating developer inside the developer container and an initial developer storing chamber 11*b*, adjacent to the developer accommodating chamber 11*a* via opening sections, for storing initial developer before use. When the developing assembly 10 is not used, the opening sections between the initial developer storing chamber 11*b* and the developer accommodating chamber 11*a* is hermetically sealed with hermetic sealing members 18 (more specifically, 18*a* and 18*b*).

Figure 2A:
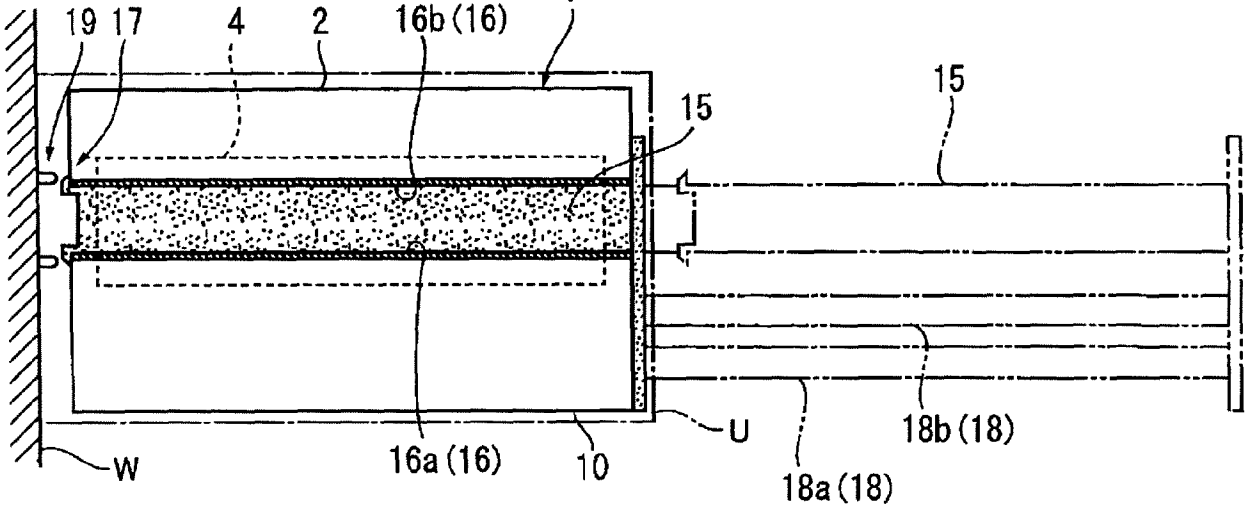
FIG. 2A is an explanatory view showing a mounting state of the image forming assembly of the image forming apparatus shown in FIG. 2A.

In this kind of mode, the work for removing the hermetic sealing members 18 (18*a* and 18*b*) may be performed independently of the work for removing the protection member 15. However, from the viewpoint of simplifying the work for removing the hermetic sealing members 18, a mode is preferably used in which the hermetic sealing members 18 are fixed to the protection member 15 as shown in FIG. 2A so as to be movable together with the protection member 15.

Among these modes, in the mode in which the protection member 15 is slidably guided along the guide members 16, the movement loci of the hermetic sealing members 18 are stabilized. Hence, this mode is preferable in that it is possible to avoid situations in which the hermetic sealing members 18 are twisted or torn off and the operation force during the movement increases.

Furthermore, the hermetic sealing members 18 should only be movable together with the protection member 15. When the operation for removing the protection member 15 is completed, it may be possible that the hermetic sealing state by the hermetic sealing members 18 is not released entirely or partly. The hermetic sealing state by the hermetic sealing members 18 should only be released by further moving the protection member 15 outwards.

However, a preferable mode of the hermetic sealing members 18 may include a mode in which, when the protection member 15 is removed from the guide members 16, the opening sections between the initial developer storing chamber 11*b* and the developer accommodating chamber 11*a* are opened and the hermetic sealing members 18 are moved together with the protection member 15 so that the initial developer is supplied into the developer accommodating chamber 11*a*.

Moreover, in a mode including a constraining mechanism 17 capable of constraining the movement of the protection member 15 with respect to the guide members 16 and capable of releasing the constrained state of the protection member 15, from the viewpoint of decreasing the operation force for releasing the hermetic sealing state by the hermetic sealing members 18, a mode is preferable in which, when the constrained state of the protection member 15 by the constraining mechanism 17 is released, the protection member 15 starts moving along the guide members 16, whereby the hermetic sealing state by the hermetic sealing members 18 is released. The releasing is herein not limited to a case in which the hermetic sealing state is entirely released but includes a case in which the hermetic sealing state is partly released.

Besides, from the viewpoint of improving the efficiency of supplying the initial developer, a mode is preferable in which multiple hermetic sealing members 18 (for example, 18*a* and 18*b*) are provided as shown in FIG. 1B.

As a preferable mode having multiple hermetic sealing members 18, from the viewpoint of decreasing the operation force required to release the hermetic sealing by the hermetic sealing members 18 (18*a* and 18*b*), a mode may be included in which the releasing operations of the hermetic sealing states of the multiple hermetic sealing members 18 (18*a* and 18*b*) are started at different times in accordance with the removal of the protection member 15.

Figure 2B:
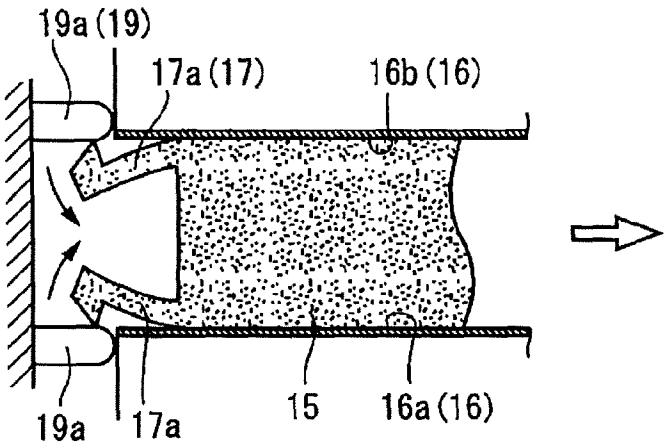
FIG. 2B is an explanatory view showing an example of a constraint-releasing structure when the protection member shown in FIG. 1 is removed.

In addition, as a preferable mode of this kind of image forming apparatus, for example, as shown in FIGS. 2A and 2B, as the mode in which the image forming assembly 1 includes the constraining mechanism 17 for constraining the movement of the protection member 15 with respect to the guide members 16, a mode may be included in which the housing W is provided with a constraint-releasing mechanism 19 capable of releasing the constrained state of the protection member 15 by the constraining mechanism 17 when the image forming assembly 1 is mounted on the receiving section U.

An example of the constraining mechanism 17 may herein include a mechanism in which the movement of the protection member 15 is constrained by a pair of constraining pieces 17*a* that are elastically deformable. As the constraint-releasing mechanism 19, for example, as shown in FIG. 2B, the mechanism should only have a configuration in which the constraining pieces 17*a* are elastically deformed when the protruding pieces 19*a* protruding toward the constraining pieces 17*a* of the constraining mechanism 17 make contact with the constraining pieces 17*a*, thereby releasing the constrained state of the protection member 15.

Furthermore, in a mode in which the housing W has a door (not shown) that is opened and closed when the image forming assembly 1 is mounted on and dismounted from the receiving section U, from the viewpoint of avoiding forgetting to remove the protection member 15, it is preferable that the protection member 15 has a mode in which the protection member 15 is removable from the image forming assembly 1 when the image forming assembly 1 is mounted on the receiving section U of the housing W, and the door of the housing W is prevented from being closed in a state that the protection member 15 is not removed from the image forming assembly 1.

The present invention will be described below in greater detail on the basis of exemplary embodiments shown in the accompanying drawings.

Exemplary Embodiment 1

Overall Configuration of Image Forming Apparatus

Figure 3:
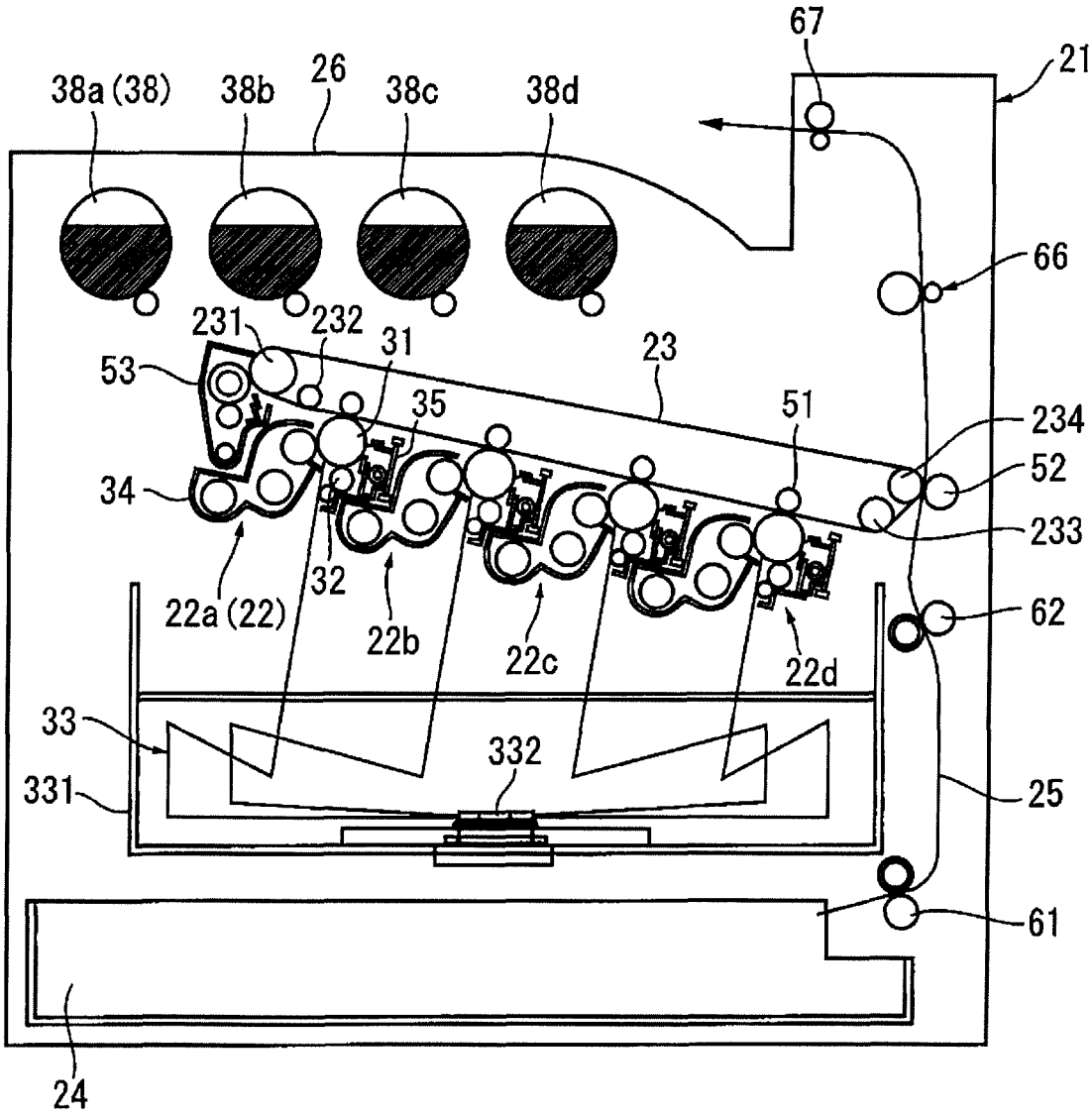
FIG. 3 is an explanatory view showing the overall configuration of the image forming apparatus being used in Exemplary Embodiment 1.

FIG. 3 shows an overall configuration of Exemplary Embodiment 1 of an image forming apparatus to which the present invention is applied.

In FIG. 3, the image forming apparatus has image forming sections 22 (more specifically, 22*a* to 22*d*) for four colors (black, yellow, magenta and cyan in this exemplary embodiment) inside the housing 21 (hereafter referred to as an apparatus housing) thereof, the image forming sections being arranged in a lateral direction and inclined obliquely upward. Above the image forming sections 22, an intermediate transfer belt 23 that is circulated and moved in the arrangement direction of the image forming sections 22 is disposed. On the other hand, a recording media supplying device 24 for accommodating recording media so as to be able to supply the recording media is disposed in the lower section of the apparatus housing 21, and a discharged recording media receiver 26 for accommodating discharged recording media on which images are formed is provided in the upper section of the apparatus housing 21. The recording media from the recording media supplying device 24 are discharged to the discharged recording media receiver 26 via a recording media conveying path 25 extending in the nearly vertical direction.

In the exemplary embodiment, the image forming sections 22 (22*a* to 22*d*) are used to form toner images having the colors of black, yellow, magenta and cyan (the arrangement of the colors is not necessarily limited to this order), for example, in the order from the upstream side in the circulation direction of the intermediate transfer belt 23 as shown in FIG. 3. The image forming section includes, for example, a photoreceptor 31 formed into a drum shape; a charger 32 for charging this photoreceptor 31 beforehand; an exposing unit 33 for writing electrostatic latent images on the photoreceptor 31 charged by the charger 32; a developing unit 34 for visualizing the electrostatic latent image on the photoreceptor 31 with toner of each color; and a cleaner 35 for removing the toner remaining on the photoreceptor 31.

The exposing unit 33 is commonly used for each of the image forming sections 22. The light from a light source, such as a semiconductor laser (not shown) of each color component, inside an exposure container 331 is used for deflection scanning by virtue of a deflecting mirror 332 so that a light image is guided to an exposure position on the corresponding photoreceptor 31 via an imaging lens and a mirror (these are not shown).

Figure 9:
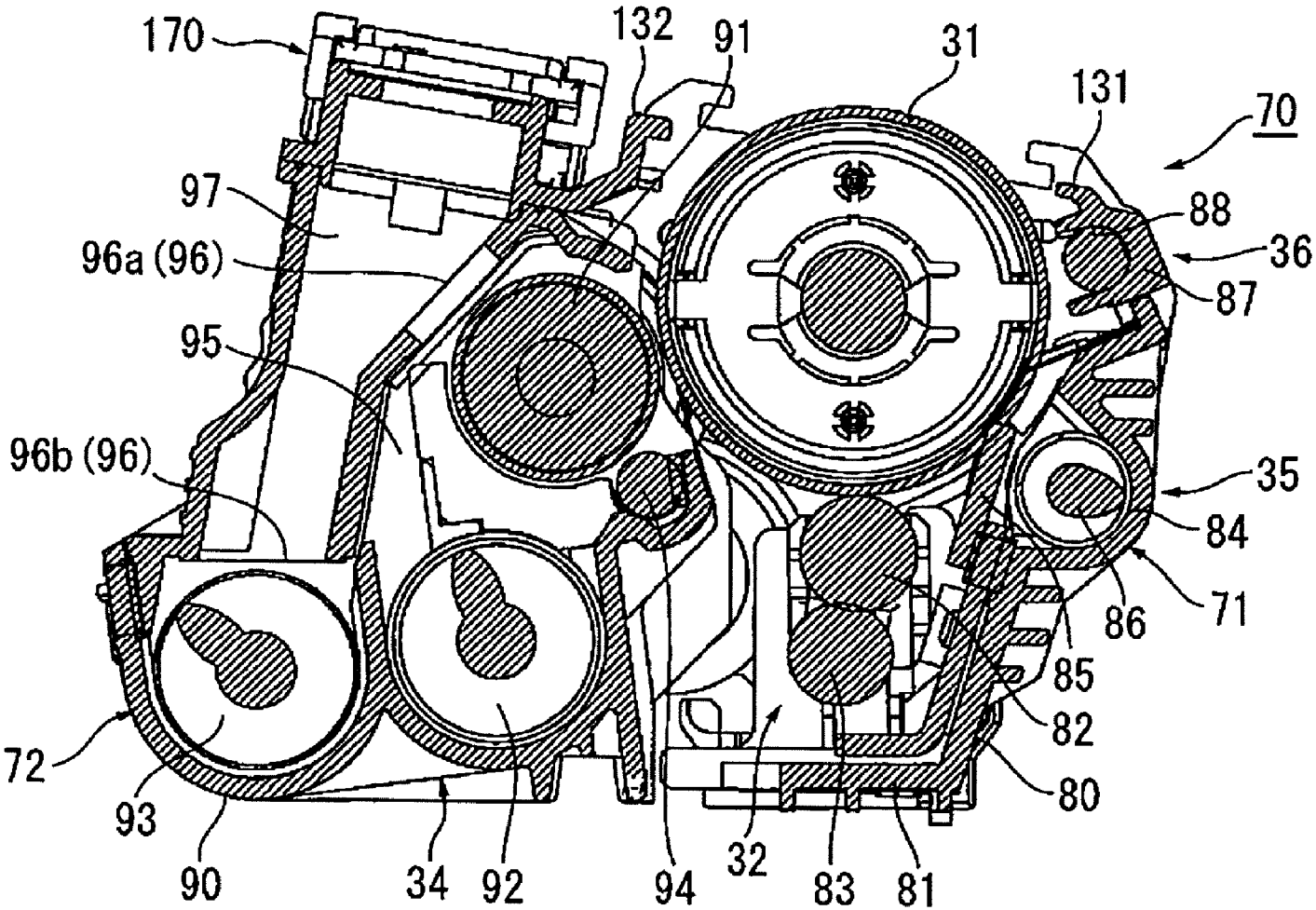
FIG. 9 is a sectional explanatory view taken on line IX-IX of FIG. 8.

In the exemplary embodiment, a neutralizing unit 36 (see FIGS. 9 and 10) for removing the charge remaining on the photoreceptor 31 is provided on the upstream side of the cleaner 35 in the rotation direction of the photoreceptor 31.

Furthermore, the intermediate transfer belt 23 is stretched around tension rolls 231 to 234 and circulates and moves by using the tension roll 231 as a driving roll, for example. A primary transfer unit 51 (for example, a primary transfer roll) is disposed on the rear face of the intermediate transfer belt 23 corresponding to each of the photoreceptors 31. The toner image on the photoreceptor 31 is electrostatically transferred to the intermediate transfer belt 23 by applying a voltage having a polarity opposed to that of the charge of the toner to this primary transfer unit 51.

Moreover, a secondary transfer unit 52 (for example, a secondary transfer roll) is disposed at a portion corresponding to the tension roll 234 on the downstream side of the image forming section 22*d* positioned on the extreme downstream side in the movement direction of the intermediate transfer belt 23, whereby secondary transfer (collective transfer) for the primary transfer images formed on the intermediate transfer belt 23 is performed on recording media.

Besides, an intermediate cleaner 53 for removing the toner remaining on the intermediate transfer belt 23 is provided at a portion corresponding to the tension roll 231 on the downstream side of the secondary transfer portion of the intermediate transfer belt 23.

A belt made of a resin, such as polyimide, polycarbonate, polyester or polypropylene, or a rubber, one of various kinds of rubbers, containing an appropriate amount of an antistatic agent, such as carbon black, so as to have a volume resistivity of $10^6$ to $10^{14}$ Ω·cm is used to form the intermediate transfer belt 23.

Still further, in the exemplary embodiment, recording media fed from the feeder 61 of the recording media supplying device 24 are conveyed by an appropriate number of conveying rolls (not shown) along the recording media conveying path 25, are position-aligned by a position aligning roll 62 and pass through the secondary transfer portion of the secondary transfer unit 52. After the unfixed toner images on the recording media are fixed by a fixing unit 66 by applying heat and pressure, for example, the recording media are discharged via a discharging roll 67 and accommodated into the discharged recording media receiver 26.

Numeral 38 (38*a* to 38*d*) in FIG. 3 designates a toner replenishing unit (toner cartridge) for replenishing new toner to the developing unit 34 of each of the image forming sections 22 (22*a* to 22*d*).

Image Forming Assembly

Figure 4:
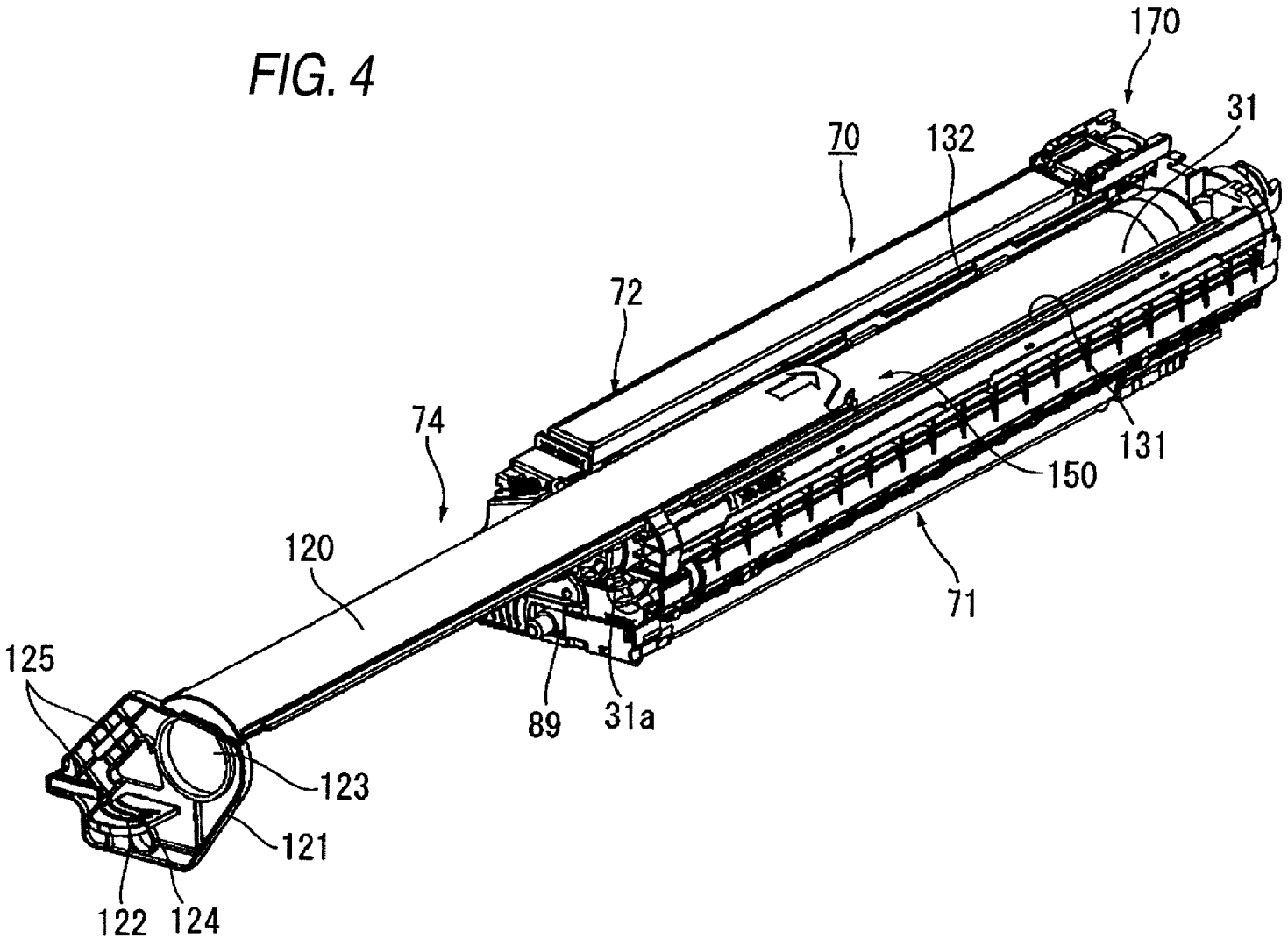
FIG. 4 is a perspective explanatory view showing an image forming assembly being used in Exemplary Embodiment 1.
Figure 5:
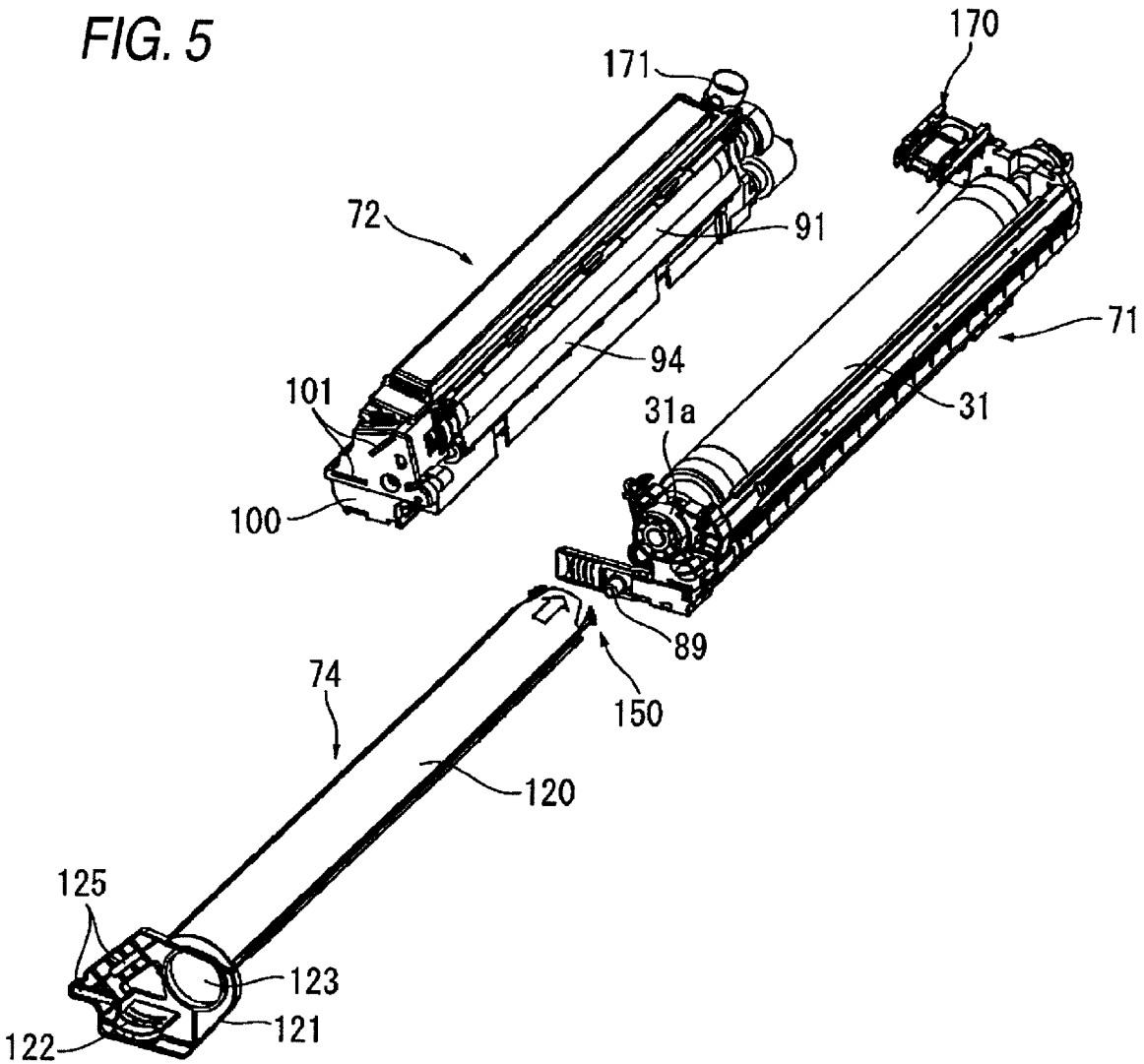
FIG. 5 is an exploded perspective view showing the image forming assembly shown in FIG. 4.

In the exemplary embodiment, as shown in FIGS. 4 to 6, the photoreceptor 31 is integrated with the charger 32, the developing unit 34, the cleaner 35 and the neutralizing unit 36 (see FIGS. 9 and 10) so as to form an image forming assembly 70. This image forming assembly 70 is detachably mounted on the assembly receiving section of the apparatus housing 21 so as to form the main section of the image forming section 22 for each color component.

In particular, in the exemplary embodiment, the image forming assembly 70 includes a photoreceptor assembly 71 incorporating the photoreceptor 31 and a developing assembly 72 rockably connected to this photoreceptor assembly 71 and incorporating the developing unit 34.

<Photoreceptor Assembly>

Figure 6B:
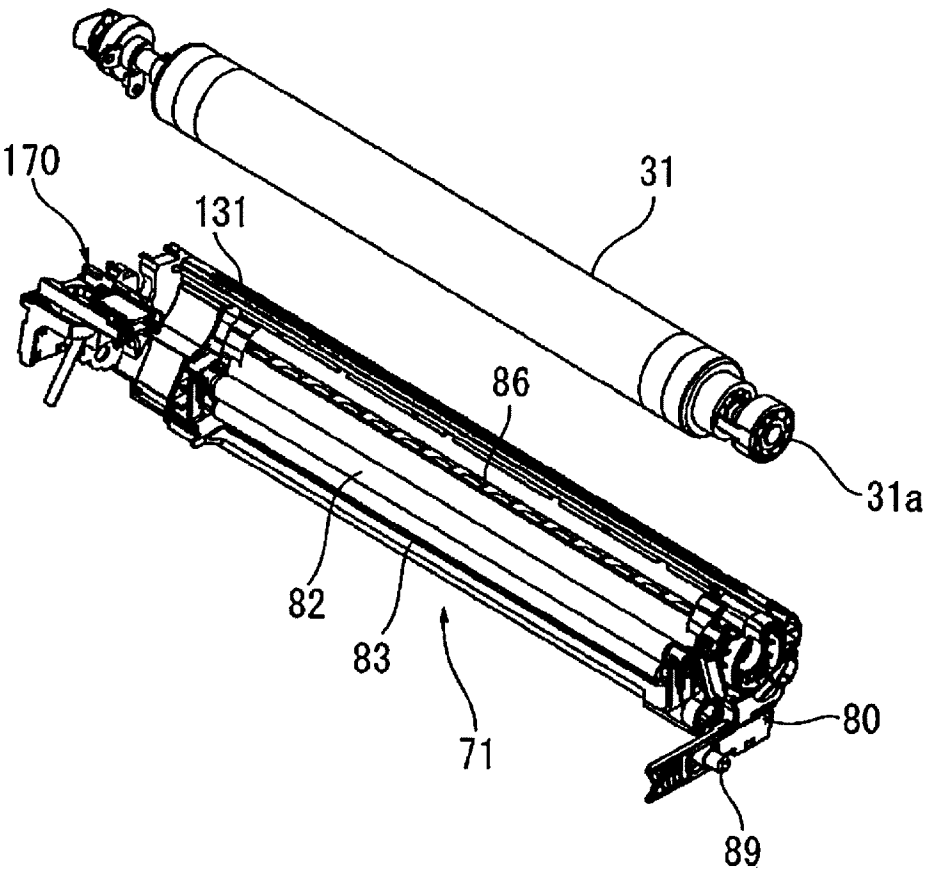
FIGS. 6A and 6B are further exploded perspective explanatory views showing the photoreceptor assembly and the developing assembly shown in FIG. 5.
Figure 7:
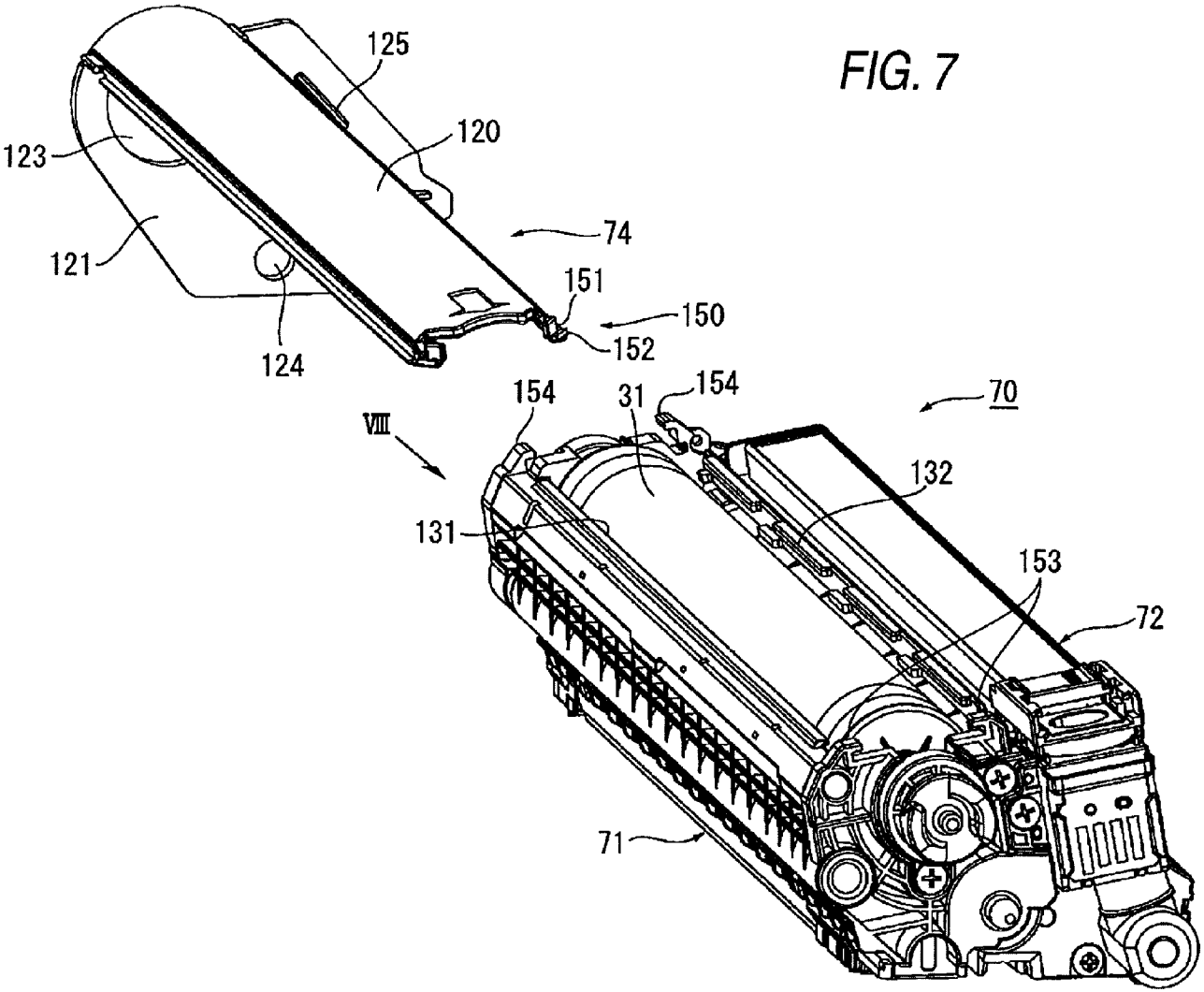
FIG. 7 is a perspective explanatory view showing a state in which a protection cover is removed from the image forming assembly shown in FIG. 4.
Figure 10:
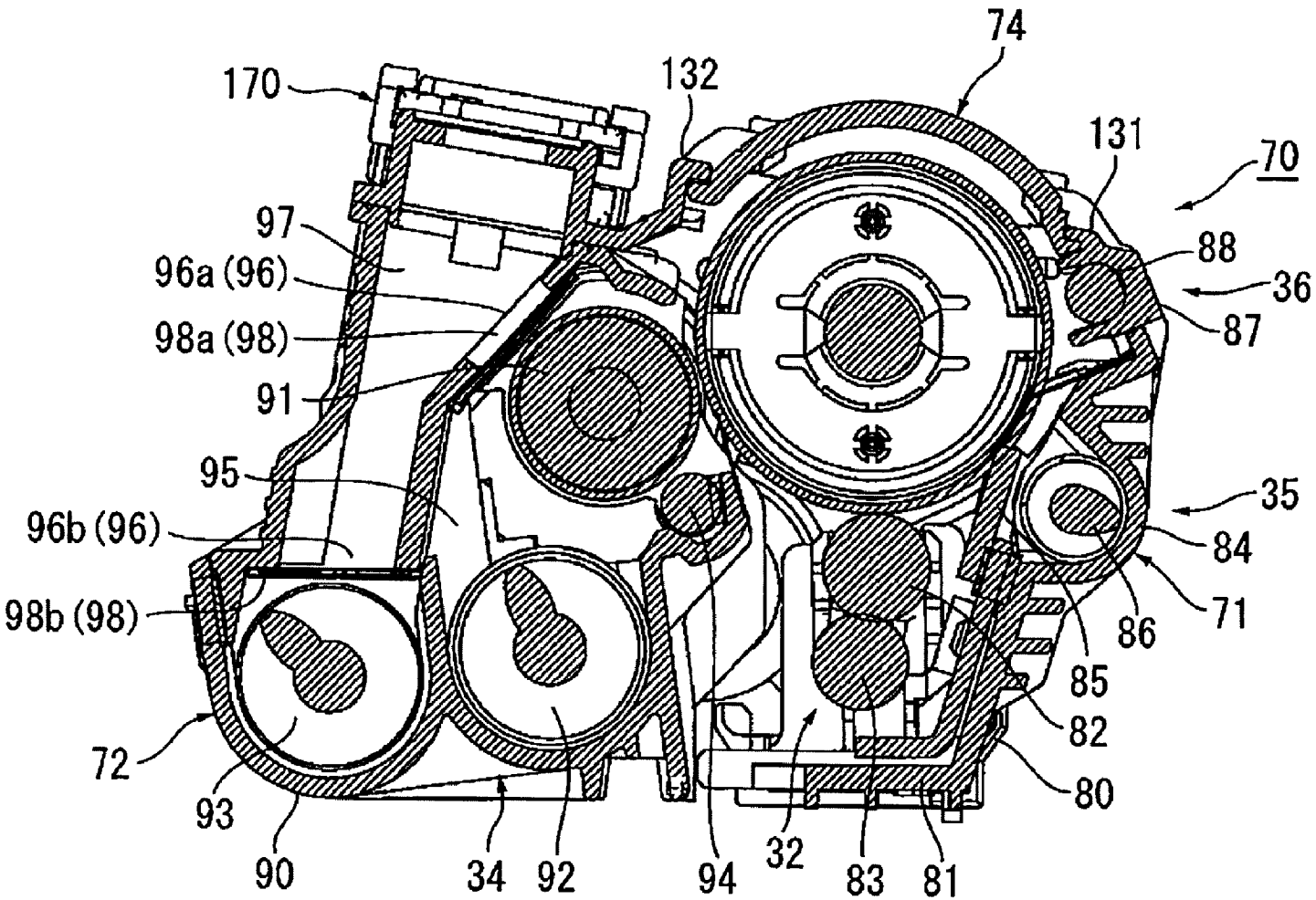
FIG. 10 is a sectional explanatory view corresponding to FIG. 9 and showing the image forming assembly before the protection cover and hermetic seals are removed.

As shown in FIGS. 6B, 7 and 10, the photoreceptor assembly 71 has an accommodating container 80 for accommodating the photoreceptor 31. The charger 32, the cleaner 35 and the neutralizing unit 36 are disposed around the photoreceptor 31 inside the accommodating container 80.

Both ends of the rotation shaft of the photoreceptor 31 are rotatably supported at both ends of the accommodating container 80. When the image forming assembly 70 is mounted, one end of the rotation shaft of the photoreceptor 31 is connected to a driving mechanism (not shown) so as to driven.

In addition, the charger 32 has a configuration in which a charge container section 81 is provided in part of the accommodating container 80, and a charging roll 82 making contact with or adjacent to the surface of the photoreceptor 31 and a power supplying roll 83 for supplying power to the charging roll 82 are provided inside the charge container section 81.

Furthermore, the cleaner 35 has a configuration in which a cleaning container section 84 is provided in part of the accommodating container 80, a plate-shaped cleaning member 85 for scraping the toner remaining on the surface of the photoreceptor 31 is provided at the fringe of the opening in the cleaning container section 84, a recovery conveying member (for example, a mode having a spiral impeller provided around the rotation shaft thereof) 86 for conveying the remaining toner scraped by the cleaning member 85 into a recovery container (not shown) is disposed inside the cleaning container section 84.

Moreover, the neutralizing unit 36 has a configuration in which a neutralizing container section 87 is provided in part of the accommodating container 80, a neutralizing radiation lens 88 is held in this neutralizing container section 87, and neutralizing light from a neutralizing lamp (not shown) is guided to this neutralizing radiation lens 88 so that the neutralizing light is irradiated to the surface of the photoreceptor 31.

<Developing Assembly>

As shown in FIGS. 7 to 10, the developing assembly 72 has a developer container 90, being open toward the photoreceptor 31, for accommodating a two-component developer containing toner and carrier particles, wherein a developing roll 91 for holding and conveying the developer is disposed at a portion facing the opening of this developer container 90, a pair of developer stirring members (for example, a mode having a spiral impeller provided around the rotation shaft thereof)) 92 and 93 is disposed on the rear face side of the developing roll 91 inside the developer container 90, and a layer thickness restricting member (for example, a layer thickness restricting roll) 94 is provided on the upstream side in the rotation direction from the developing portion of the developing roll 91 to restrict the thickness of the developer layer held on the developing roll 91.

Furthermore, in the exemplary embodiment, the developer container 90 has a developer accommodating chamber 95 in which the developer is accommodated at the mounting time of the image forming assembly 70 and in which the developing roll 91 and the developer stirring members 92 and 93 are disposed; and an initial developer storing chamber 97, disposed adjacent to this developer accommodating chamber 95 via the opening sections 96 (in the exemplary embodiment, multiple opening sections 96*a* and 96*b*), for storing the initial developer when the image forming assembly 70 is not mounted, wherein, when the image forming assembly 70 is not mounted, that is, when the developing assembly 72 is not used, the opening sections 96 (96*a* and 96*b*) between the initial developer storing chamber 97 and the developer accommodating chamber 95 are hermetically sealed with hermetic seals 98 (in the exemplary embodiment, 98*a* and 98*b*).

The installation structure of the hermetic seals 98 will be described later.

Figure 6A:
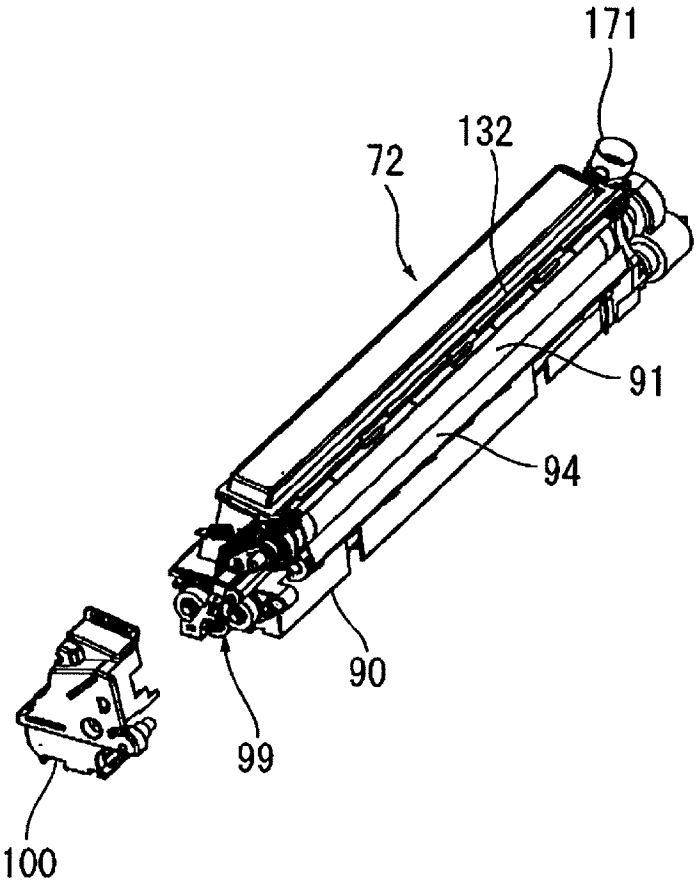

Moreover, as shown in FIG. 6A, a drive transmission mechanism 99 formed of, for example, drive transmission gears, for driving the developing roll 91 and the developer stirring members 92 and 93 is provided outside the developer container 90 positioned on one axial end side of the developing roll 91. The drive transmission mechanism 99 is covered with an external covering member 100.

<Installation Structures of Photoreceptor Assembly and Developing Assembly>

Figure 11A:
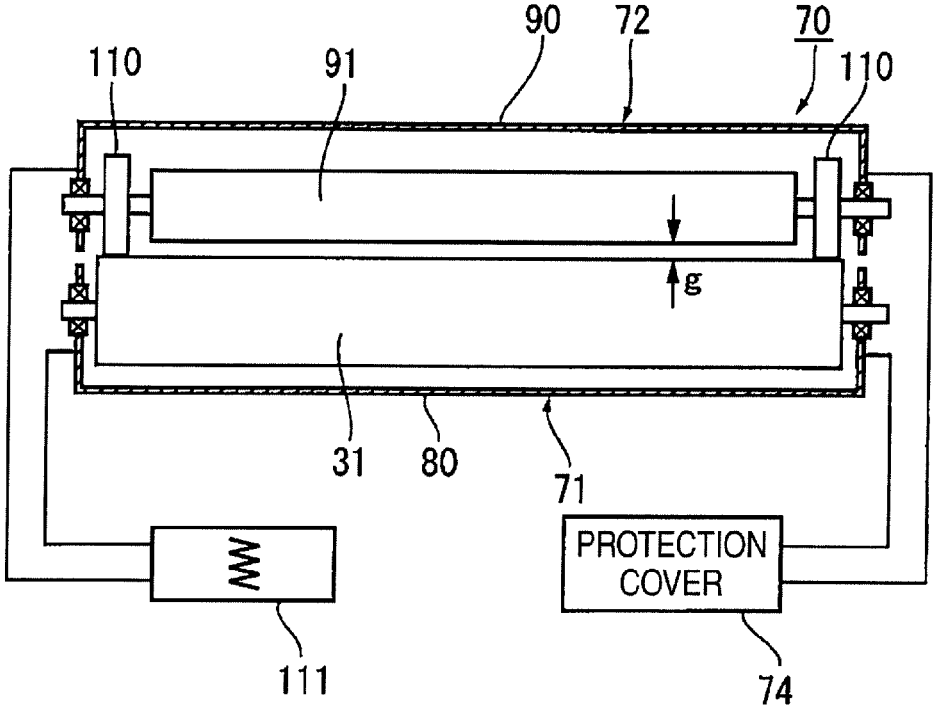
FIG. 11A is an explanatory view showing the relationship between the photoreceptor assembly and the developing assembly of the image forming assembly shown in FIG. 10.
Figure 11B:
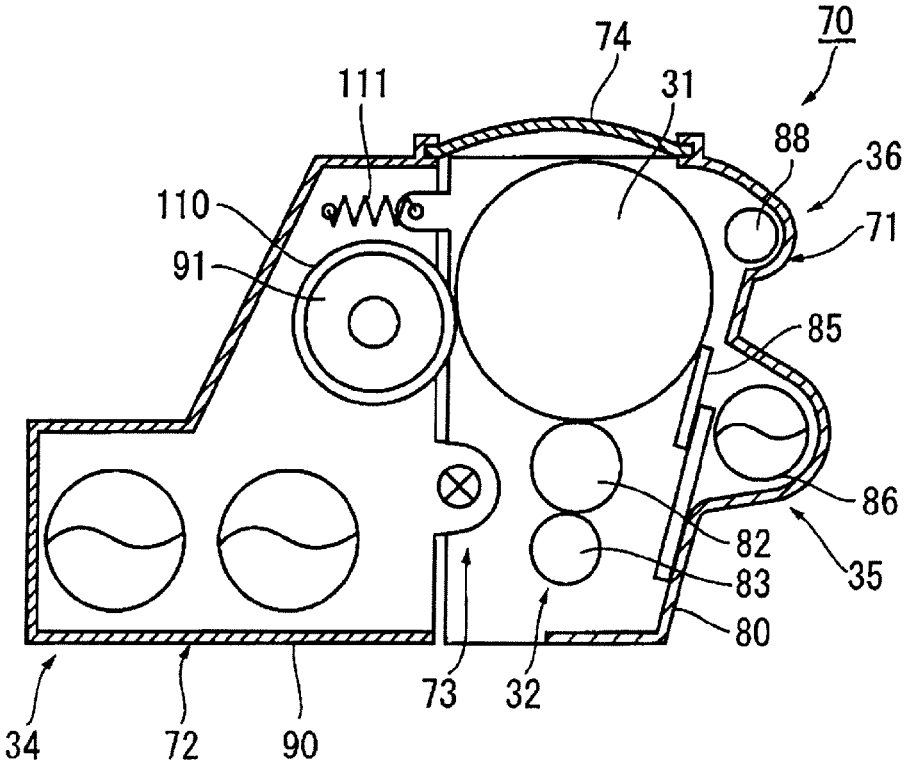
FIG. 11B is an vertical sectional explanatory view of FIG. 11A.

In the exemplary embodiment, the photoreceptor assembly 71 and the developing assembly 72 are rockably supported via a connecting mechanism 73 as shown in FIG. 11B.

In the exemplary embodiment, the connecting mechanism 73 rockably connects the installation pieces at both longitudinal ends of the accommodating container 80 of the photoreceptor assembly 71 to the installation pieces at both longitudinal ends of the developer container 90 of the developing assembly 72 via a pivot shaft.

The connecting mechanism 73 is provided at a portion away from the portion at which the photoreceptor 31 is opposed to the developing roll 91.

In addition, in the exemplary embodiment, tracking rolls 110, having a diameter slightly larger than that of the developing roll 91, for performing positional adjustment are provided at both ends of the developing roll 91. The gap g between the developing roll 91 and the photoreceptor 31 is adjusted to a predetermined amount by making the tracking rolls 110 come into contact with the surface of the photoreceptor 31.

Furthermore, as shown in FIG. 11A, a biasing spring 111 is provided between the developer container 90 of the developing assembly 72 and the accommodating container 80 of the photoreceptor assembly 71, and this biasing spring 111 exerts a bias force in the direction of pressing the tracking rolls 110 to the photoreceptor 31.

Protection Cover

In the exemplary embodiment, as shown in FIGS. 4 to 10, the photoreceptor assembly 71 serving as one component of the image forming assembly 70 is disposed so that the photoreceptor 31 is exposed at the portion opposed to the intermediate transfer belt 23 when the image forming assembly 70 is mounted.

Hence, a protection cover 74 for covering the exposed portion of the photoreceptor 31 is provided when the image forming assembly 70 is not mounted.

This protection cover 74 has a long plate-shaped member 120 extending in the axial direction of the photoreceptor 31 so as to correspond to the exposed portion of the photoreceptor 31 made of a synthetic resin. The transverse section of this long plate-shaped member 120 is formed into a shape curved in the circumferential direction of the photoreceptor 31.

In the exemplary embodiment, the protection cover 74 has a bent member 121 integrated therewith and being bent at a nearly right angle on one longitudinal end side of the long plate-shaped member 120, and a handle 122 is formed on this bent member 121. In addition, the bent member 121 is provided with an opening 123 to avoid interference with the rotation bearing section 31*a* of the photoreceptor 31. Furthermore, the bent member 121 is provided with a positioning hole 124 into which a positioning protrusion 89 formed on the accommodating container 80 of the photoreceptor assembly 71 is inserted.

Moreover, rail-shaped guide members 131 and 132 are provided at the fringes of the openings of the accommodating container 80 of the photoreceptor assembly 71 and the developer container 90 of the developing assembly 72, respectively, in the axial direction of the photoreceptor 31 and at portions corresponding to the exposed portion of the photoreceptor 31. These guide members 131 and 132 may be provided in the axial direction of the photoreceptor 31 continuously or discontinuously.

Still further, both side sections of the protection cover 74, formed in the width direction thereof and intersecting with the longitudinal direction thereof, are held by the guide members 131 and 132 of the assemblies 71 and 72, whereby the protection cover 74 is made slidably movable along the guide members 131 and 132.

In particular, in the exemplary embodiment, the protection cover 74 is moved and mounted along the guide members 131 and 132 from one longitudinal end side of the image forming assembly 70 so as to cover the exposed portion of the photoreceptor 31. When removing the protection cover 74, the protection cover 74 is moved along the guide members 131 and 132 in the direction opposite to the mounting direction so that the exposed portion of the photoreceptor 31 is opened.

Constraining Mechanism

Figure 12:
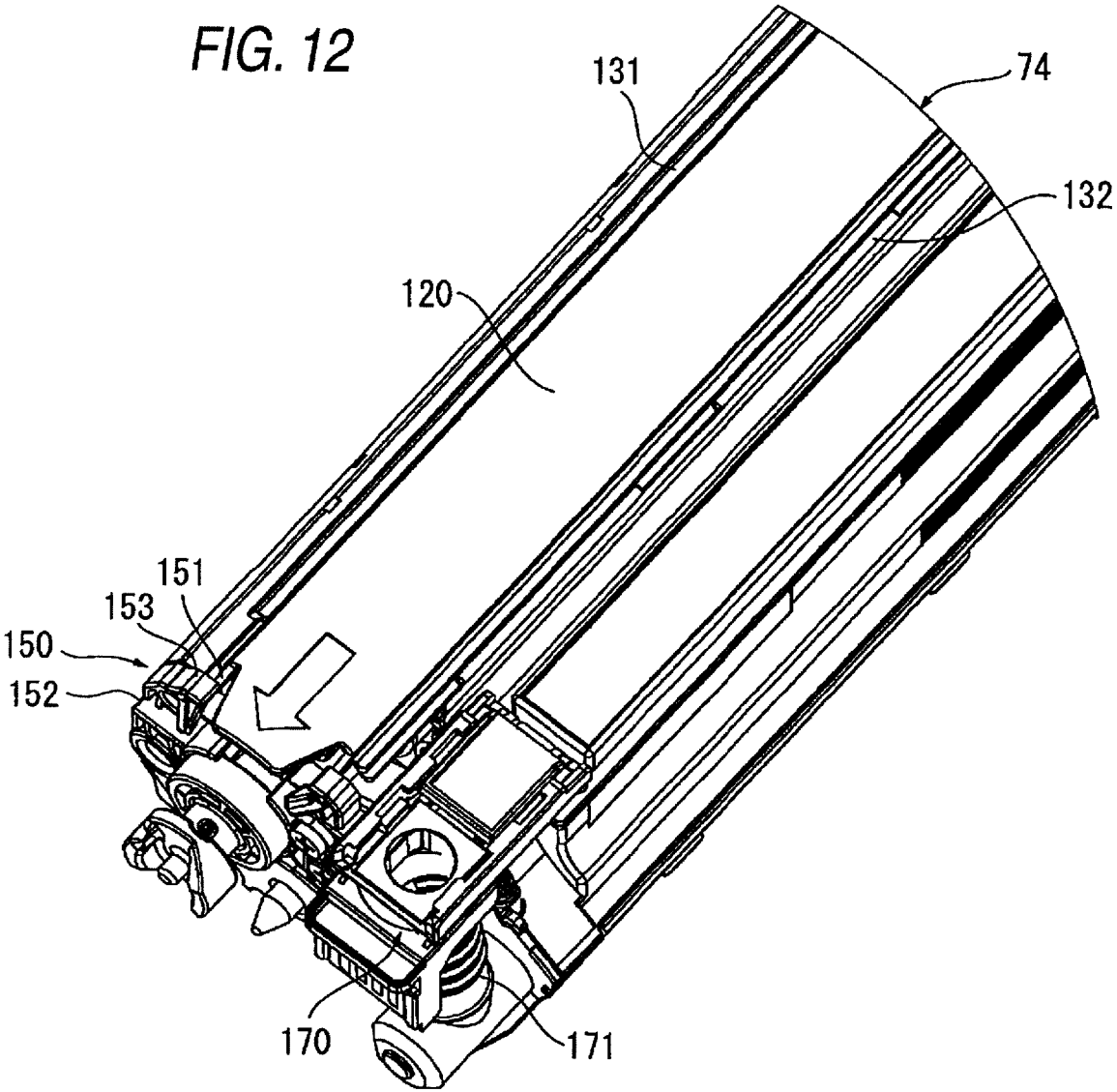
FIG. 12 is a perspective explanatory view showing a mechanism for constraining the protection cover of the image forming assembly shown in FIG. 10.
Figure 13:
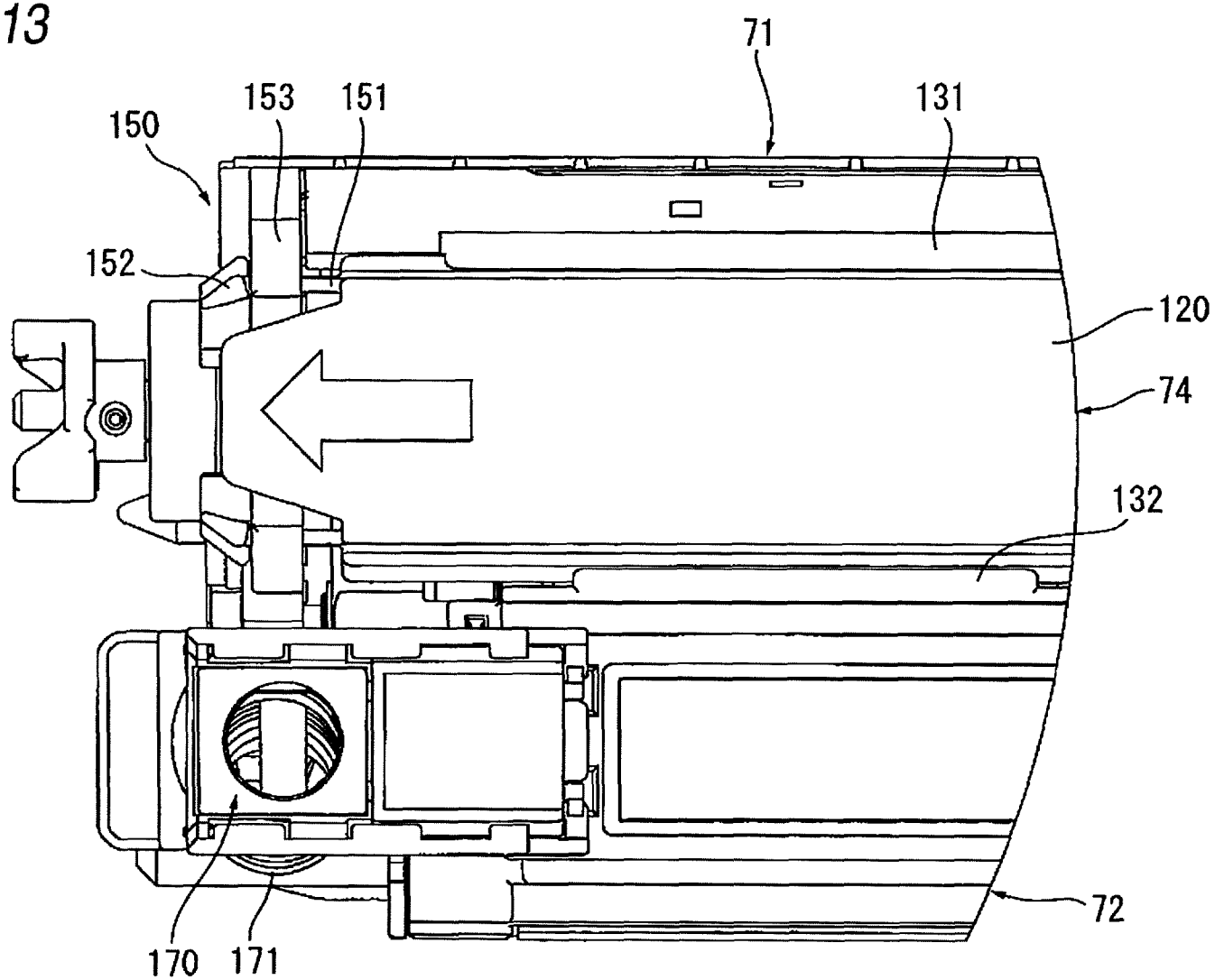
FIG. 13 is a magnified plan explanatory view showing main sections shown in FIG. 12.

A constraining mechanism 150 for constraining the movement of the protection cover 74 when the image forming assembly 70 is not mounted is provided as shown in FIGS. 12 to 14, for example, on one longitudinal end side of the protection cover 74.

In the constraining mechanism 150, a pair of elastic protruding pieces 151, elastically deformable, is formed at the tip of the long plate-shaped member 120 of the protection cover 74, and a hook-shaped pawl 152 extending outwards is formed at the protruding end of the elastic protruding piece 151. On the other hand, constrained pieces 153 over which the pawls 152 of the pair of elastic protruding pieces 151 ride and with which the pawls 152 engage are formed at the back side ends of the guide members 131 and 132 of the assemblies 71 and 72. Guide groove pieces 154 (see FIG. 8) for allowing the insertion of the pawls 152 of the pair of elastic protruding pieces 151 are provided at the front side ends of the guide members 131 and 132 of the assemblies 71 and 72.

Constraint-releasing Mechanism

Figure 14A:
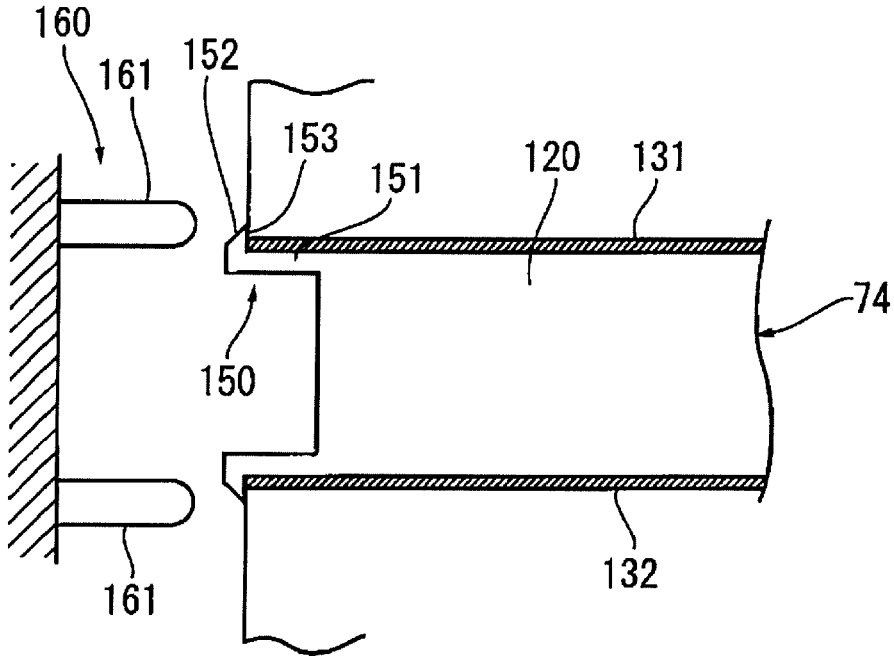
FIG. 14A is an explanatory view showing an example of the constraint-releasing mechanism of the protection cover.
Figure 14B:
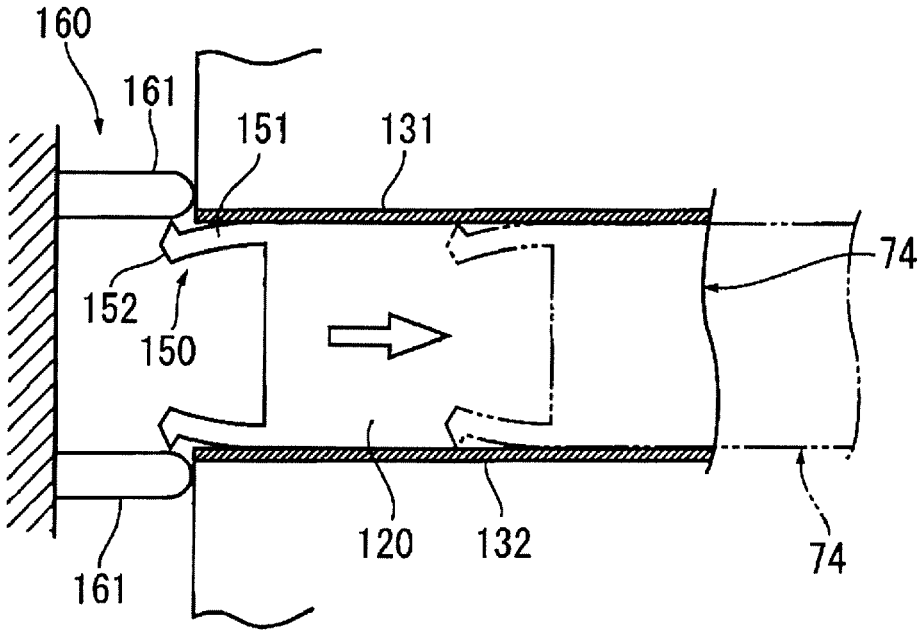
FIG. 14B is an explanatory view showing the action of the constraint-releasing mechanism of the protection cover shown in FIG. 14A.

In the exemplary embodiment, as shown in FIGS. 14A and 14B, a constraint-releasing mechanism 160 is provided to release the constraining state obtained by the constraining mechanism 150 of the protection cover 74 when the image forming assembly 70 is mounted.

As shown in FIGS. 14A and 14B, in this constraint-releasing mechanism 160, a pair of releasing protruding pieces 161 is provided on the housing 21 at portions corresponding to the pawls 152 of the pair of elastic protruding pieces 151 of the constraining mechanism 150 of the protection cover 74. The pawls 152 of the elastic protruding pieces 151 are made contact with the releasing protruding pieces 161, whereby the elastic protruding pieces 151 are elastically deformed so that the pawls 152 become closer to each other and so that the pawls 152 are disengaged from the constrained pieces 153.

Toner Replenishing Mechanism

Figure 15B:
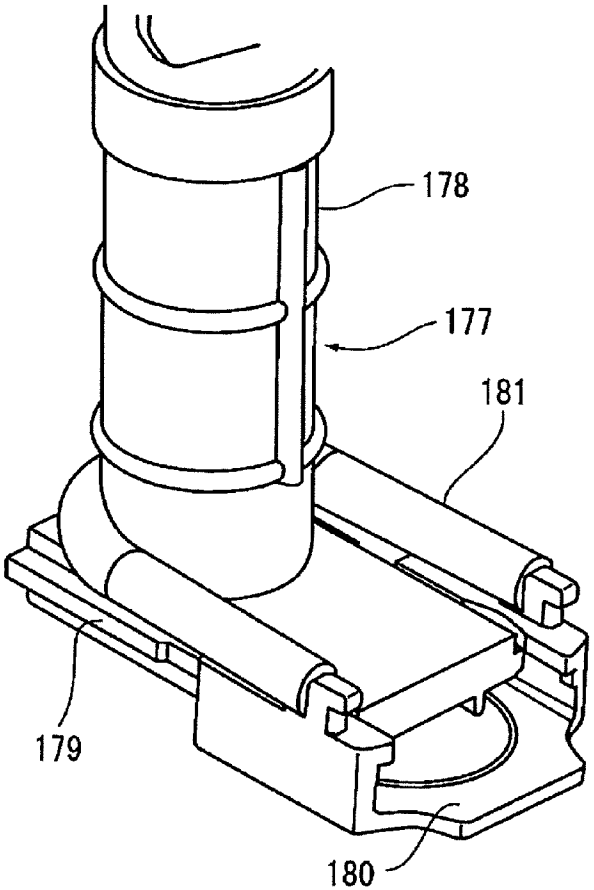
FIG. 15B is an explanatory view showing the components of the toner replenishing mechanism on the side of a toner cartridge.
Figure 15A:
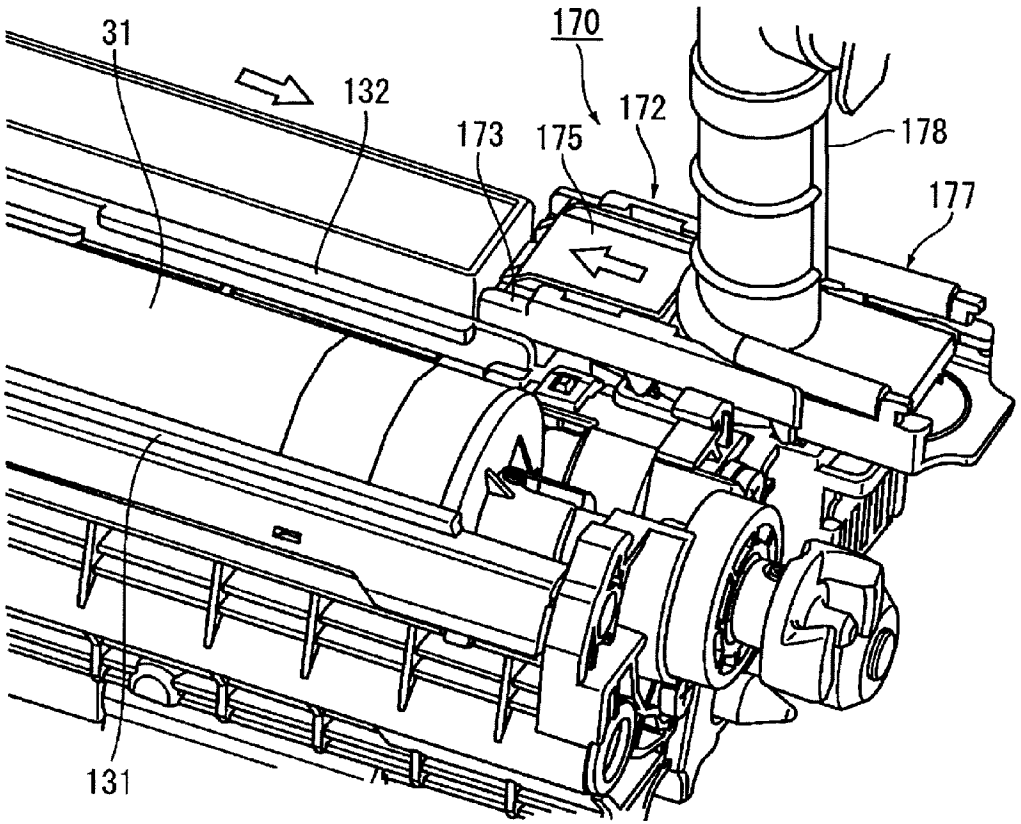
FIG. 15A is an explanatory view showing an example of a toner replenishing mechanism for the image forming assembly being used in Exemplary Embodiment 1.
Figure 16:
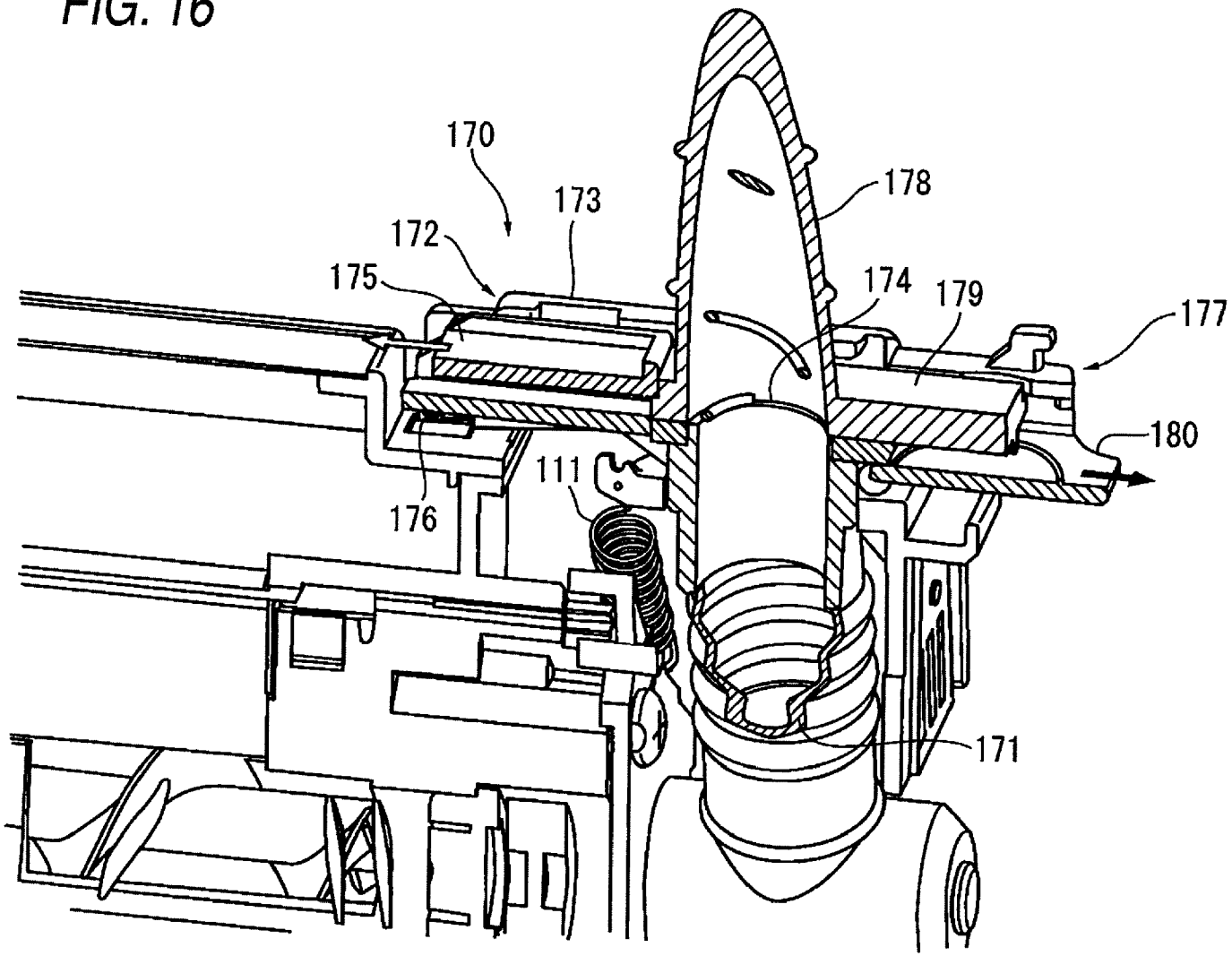
FIG. 16 is an explanatory view showing a state of the toner replenishing mechanism shown in FIGS. 15A and 15B when the image forming assembly being used in Exemplary Embodiment 1 is mounted.
Figure 17A:
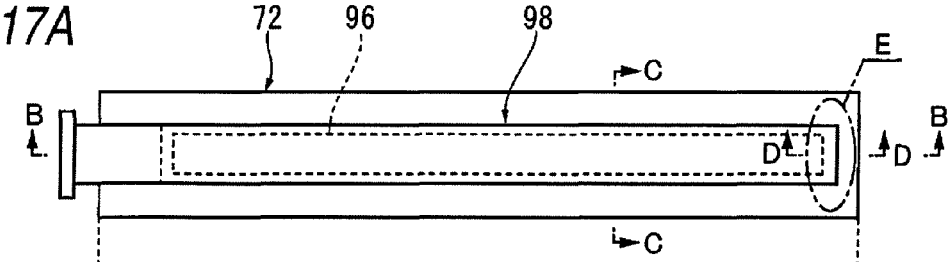
FIG. 17A is an explanatory view showing the installation structure of the hermetic seal.
Figure 17B:
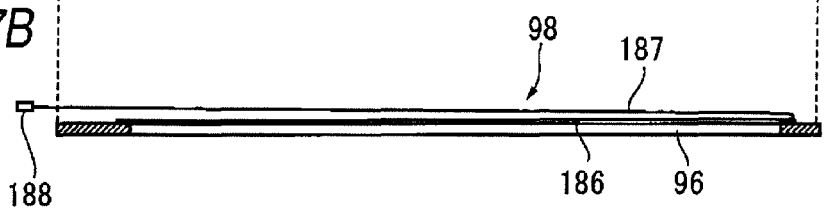
FIG. 17B is a sectional explanatory view taken on line B-B of FIG. 17A.
Figure 17C:
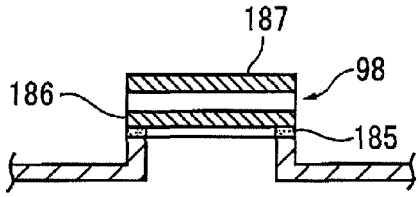
FIG. 17C is a sectional explanatory view taken on line C-C of FIG. 17A.
Figure 17D:
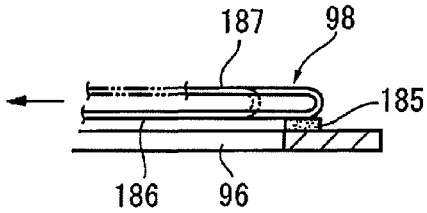
FIG. 17D is a sectional explanatory view taken on line D-D of FIG. 17A.
Figure 17E:
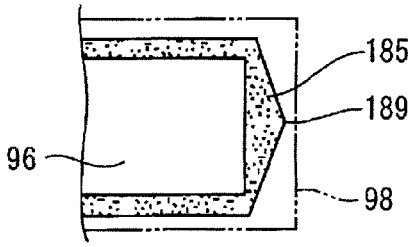
FIG. 17E is a magnified explanatory view showing section E of FIG. 17A.

In the exemplary embodiment, between the developing assembly 72 of the image forming assembly 70 and the toner replenishing unit 38, a toner replenishing mechanism 170 capable of making the connection between the two when the image forming assembly 70 is mounted is provided as shown in FIGS. 15 and 16.

This toner replenishing mechanism 170 is provided with a flexible pipe 171 made of a flexible material and communicating with the developer container 90. This flexible pipe 171 is provided with a shutter mechanism 172 (having a mode in which an input port 174 is opened in a shutter base 173, a shutter member 175 is movably provided on the shutter base 173, and the shutter member 175 is biased by a biasing spring 176 in a direction of closing the input port 174). On the other hand, the toner replenishing unit 38 is provided with a shutter-releasing mechanism 177 (having a mode in which a shutter-releasing member 179 making contact with the shutter member 175 is provided at the tip of a connection pipe 178 extending from the toner replenishing unit 38, and this shutter-releasing member 179 is provided with a positioning member 180 for positioning the shutter base 173 so that the positioning member 180 is pressed toward the shutter base 173 by a biasing spring 181) at a portion making contact with the shutter member 175 of the shutter mechanism 172.

In the exemplary embodiment, since the shutter mechanism 172 can swing with respect to the flexible pipe 171, when the image forming assembly 70 is mounted, the shutter mechanism 172 is positioned at a position corresponding to the shutter-releasing mechanism 177, and the shutter member 175 of the shutter mechanism 172 is moved by the shutter-releasing mechanism 177 so as to open the input port 174.

Installation Structure of Hermetic Seals

In the exemplary embodiment, as shown in FIG. 9 and FIGS. 17A to 17E, the hermetic seals 98 (98*a* and 98*b*) of the developing assembly 72 have hermetic sealing sections 186 peelably attached to the fringes of the opening sections 96 (96*a* and 96*b*) of the developer container 90 via a heat-welding adhesive 185, for example, and non-adhesive extended bent sections 187 being bent from the hermetic sealing sections 186. Gripping sections 188 are installed at the tips of these extended bent sections 187.

In the exemplary embodiment, the application pattern 189 of the adhesive 185 applied between the hermetic sealing section 186 and the extended bent section 187 is formed into a mountain shape toward the side from which the hermetic sealing section 186 begins to be peeled so that the force for peeling the hermetic sealing section 186 is reduced.

Figure 8:
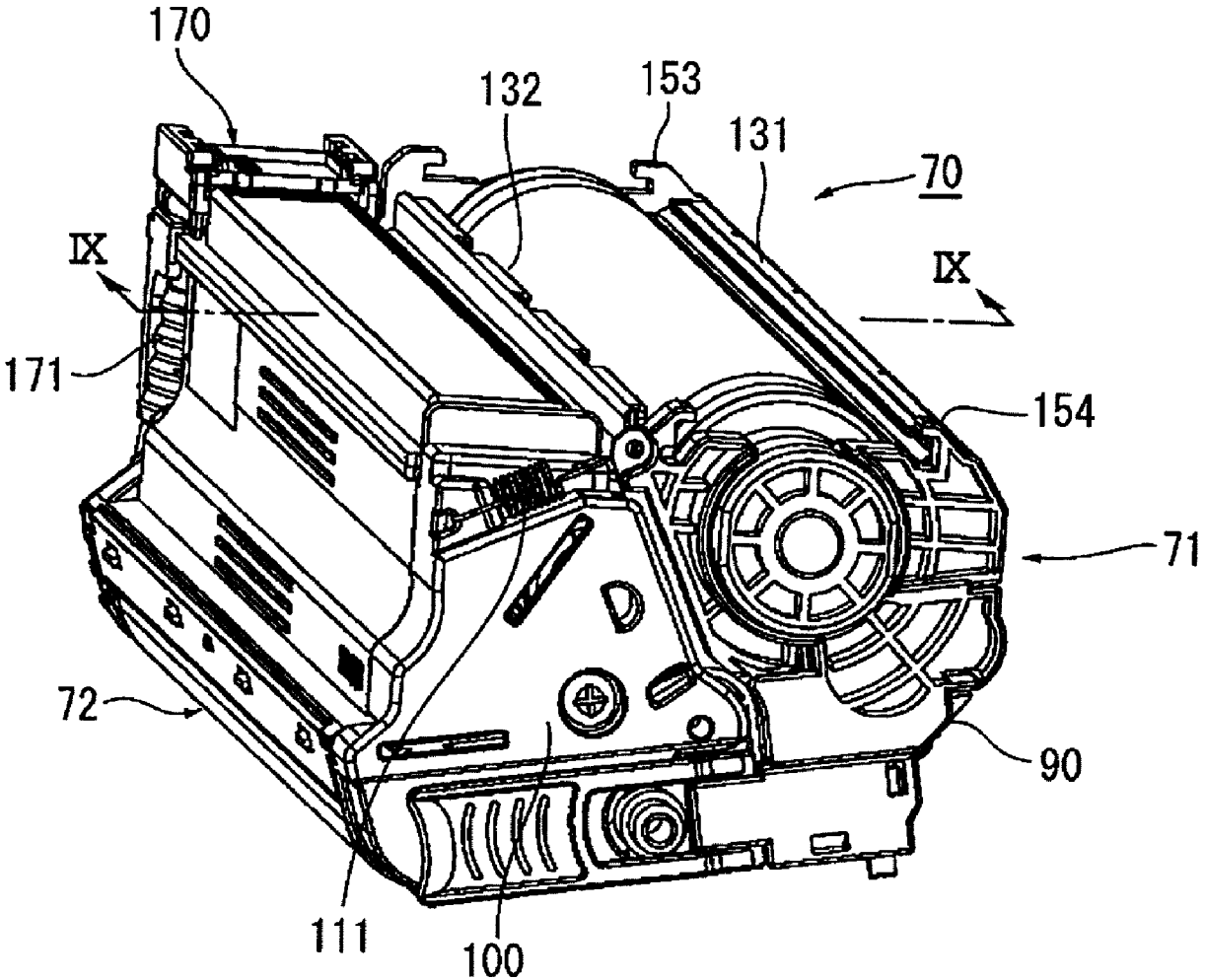
FIG. 8 is a view seen from arrow VIII of FIG. 7.

In addition, in the exemplary embodiment, as shown in FIG. 8, the gripping sections 188 of the hermetic seals 98 (98*a* and 98*b*) can be extracted from slits 101 (see FIG. 5) provided in the outer covering member 100 of the developing assembly 72.

Furthermore, in the exemplary embodiment, since slits 125 corresponding to the gripping sections 188 of the hermetic seals 98 (98*a* and 98*b*) are provided in the bent member 121 of the protection cover 74, the hermetic seals 98 may be removed after the protection cover 74 is removed, or the hermetic seals 98 may also be removed before the protection cover 74 is removed.

State when Image Forming Assembly is not Mounted

In the exemplary embodiment, the image forming assembly 70 is held on the guide members 131 and 132 while the protection cover 74 is lying astride the photoreceptor assembly 71 and the developing assembly 72 when the image forming assembly is not mounted.

Hence, as shown in FIGS. 11A and 11B, since the positional relationship between the photoreceptor assembly 71 and the developing assembly 72 is restricted by the protection cover 74, when the image forming assembly 70 is stored or conveyed, the tracking rolls 110 of the developing assembly 72 do not unnecessarily collide with the photoreceptor 31 of the photoreceptor assembly 71. Furthermore, the photoreceptor assembly 71 and the developing assembly 72 can be held in a direction away from each other by making the width of the protection cover 74 in a direction orthogonal to the longitudinal direction thereof larger than the distance between the guide members 131 and 132.

Mounting Processing of Image Forming Assembly

Figure 18:
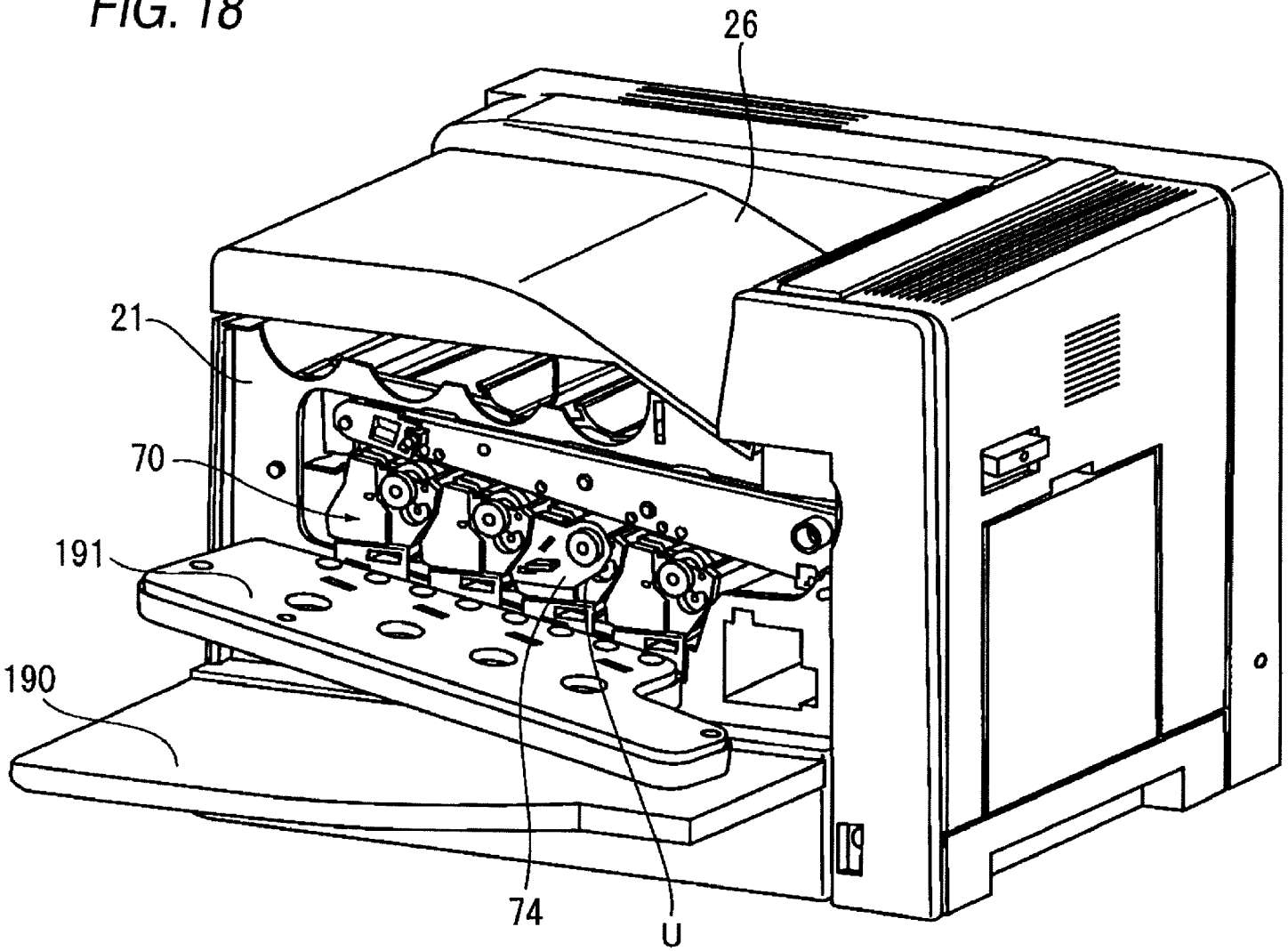
FIG. 18 is an explanatory view showing the process of mounting the image forming assembly on the housing of the image forming apparatus in Exemplary Embodiment 1.
Figure 19:
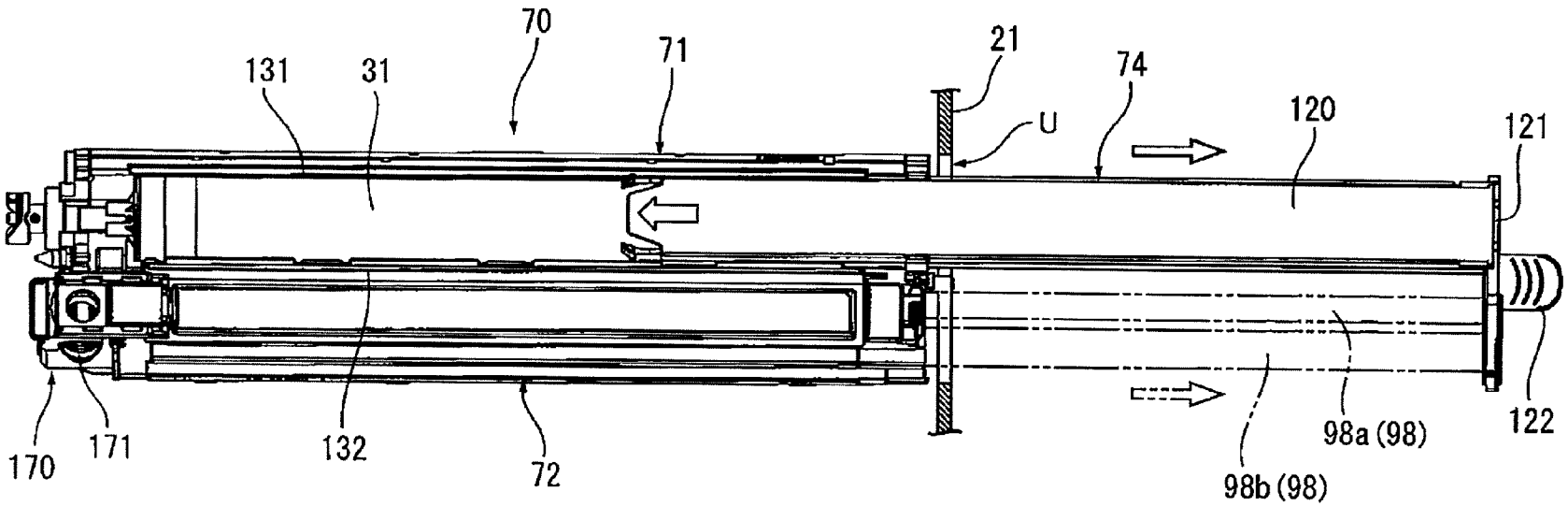
FIG. 19 is an explanatory view showing a state in which the protection cover and the hermetic seals are removed from the image forming assembly shown in FIG. 18.

In the exemplary embodiment, as shown in FIGS. 18 and 19, when the image forming assembly 70 is mounted on the receiving section U of the housing 21, the front door 190 of the housing 21 is opened, and a door 191 for opening/closing the receiving section U is opened. Then, the image forming assembly 70 should only be inserted into the receiving section U so that the image forming assembly 70 is pushed to a predetermined mounting position.

In this state, the image forming assembly 70 is mounted on the receiving section U. In the exemplary embodiment, since the constrained state of the protection cover 74 by the constraining mechanism 150 is released by the constraint-releasing mechanism 160 of the receiving section U, the protection cover 74 should only be extracted in the extraction direction thereof by grasping and pulling the handle 122 of the protection cover 74.

In this state, the protection cover 74 is moved slidably along the guide members 131 and 132 in the extraction direction, and the movement locus of the protection cover 74 is stable. Hence, for example, in a mode in which the protection cover 74 is disposed so as not make contact with in the photoreceptor 31, the protection cover 74 does not unnecessarily make contact with the photoreceptor 31 and peripheral components around the protection cover 74.

In addition, in the exemplary embodiment, in a state in which the image forming assembly 70 is mounted on the receiving section U, after the protection cover 74 is removed or before the protection cover 74 is removed, the hermetic sealing state by the hermetic seals 98 (98*a* and 98*b*) should only be released by hold and pulling the gripping sections 188 of the hermetic seals 98 (98*a* and 98*b*).

Furthermore, in the exemplary embodiment, in a state in which the image forming assembly 70 is mounted on the receiving section U, the developing assembly 72 and the toner replenishing unit 38 are connected to each other via the toner replenishing mechanism 170 while they are position-aligned.

Hence, when the image forming assembly 70 is mounted, the connection work for the toner replenishing path is not required to be performed separately.

Moreover, in the exemplary embodiment, unless the protection cover 74 is removed, the gripping sections 188 make contact with the door 191, and the door 191 cannot be closed. Hence, there is no fear of mounting the image forming assembly 70 while the protection cover 74 remains unremoved.

Exemplary Embodiment 2

Figure 20:
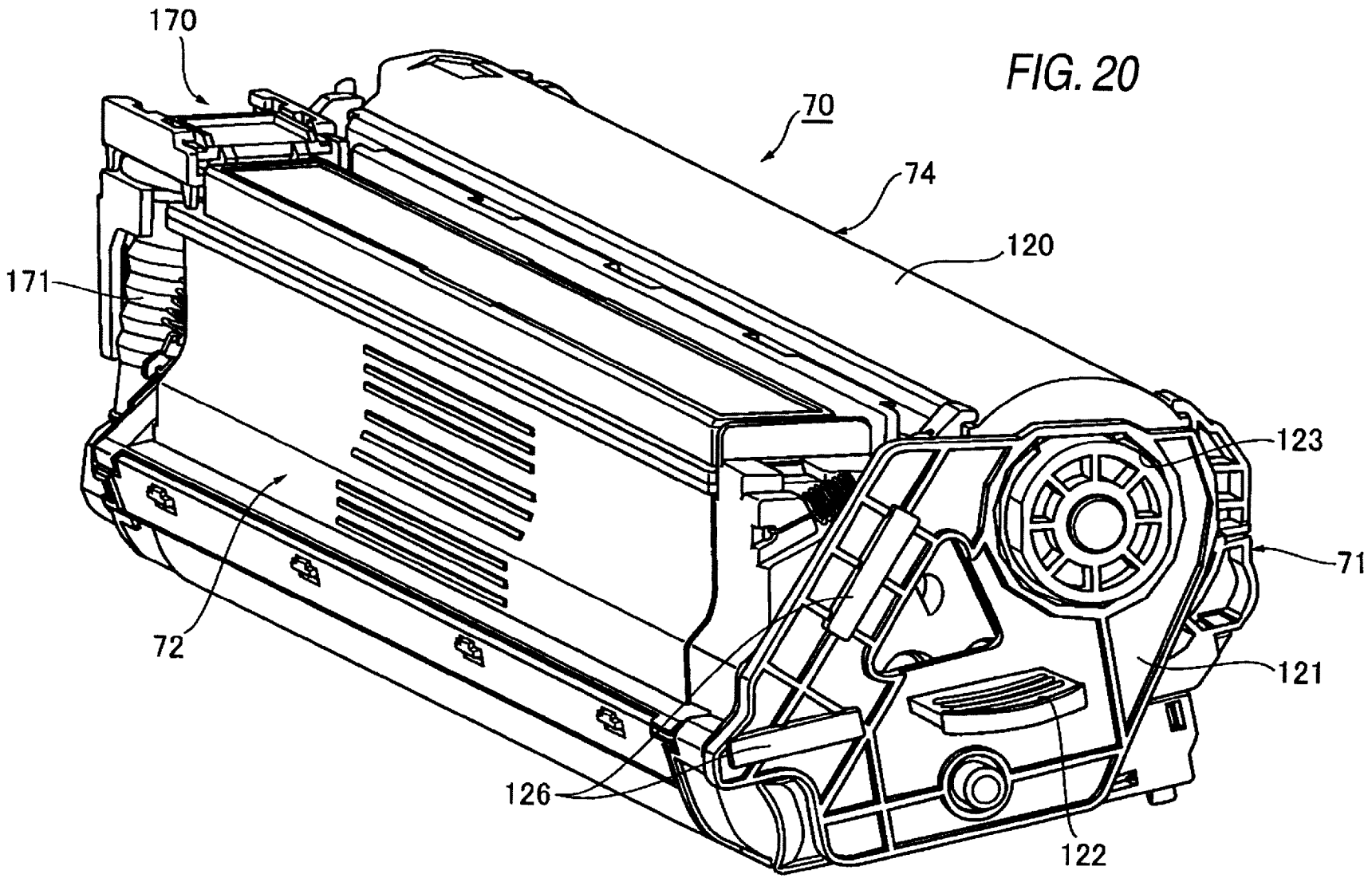
FIG. 20 is a perspective explanatory view showing an image forming assembly being used in Exemplary Embodiment 2.
Figure 21:
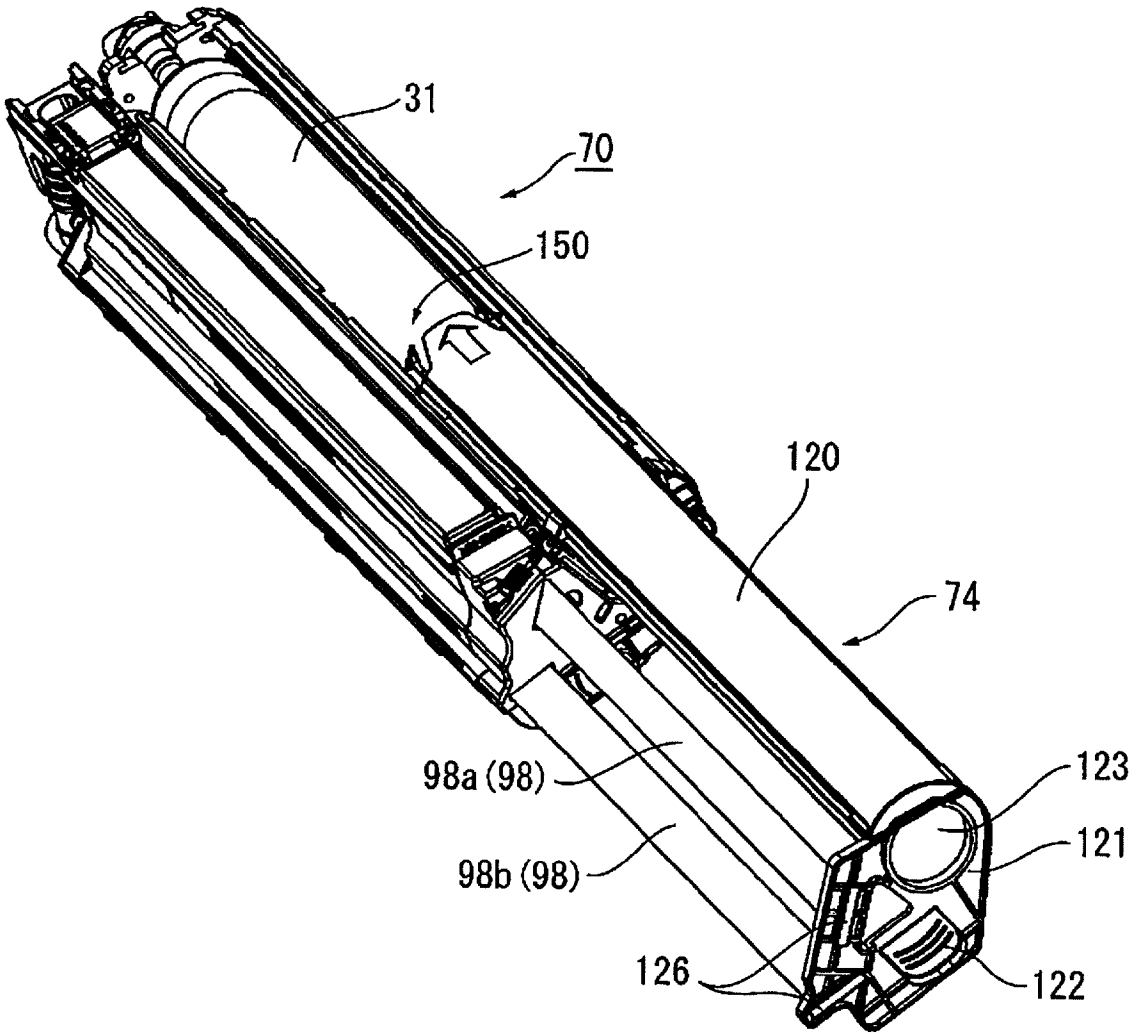
FIG. 21 is a perspective explanatory view showing a state in which the protection cover is removed from the image forming assembly being used in Exemplary Embodiment 2.
Figure 22:
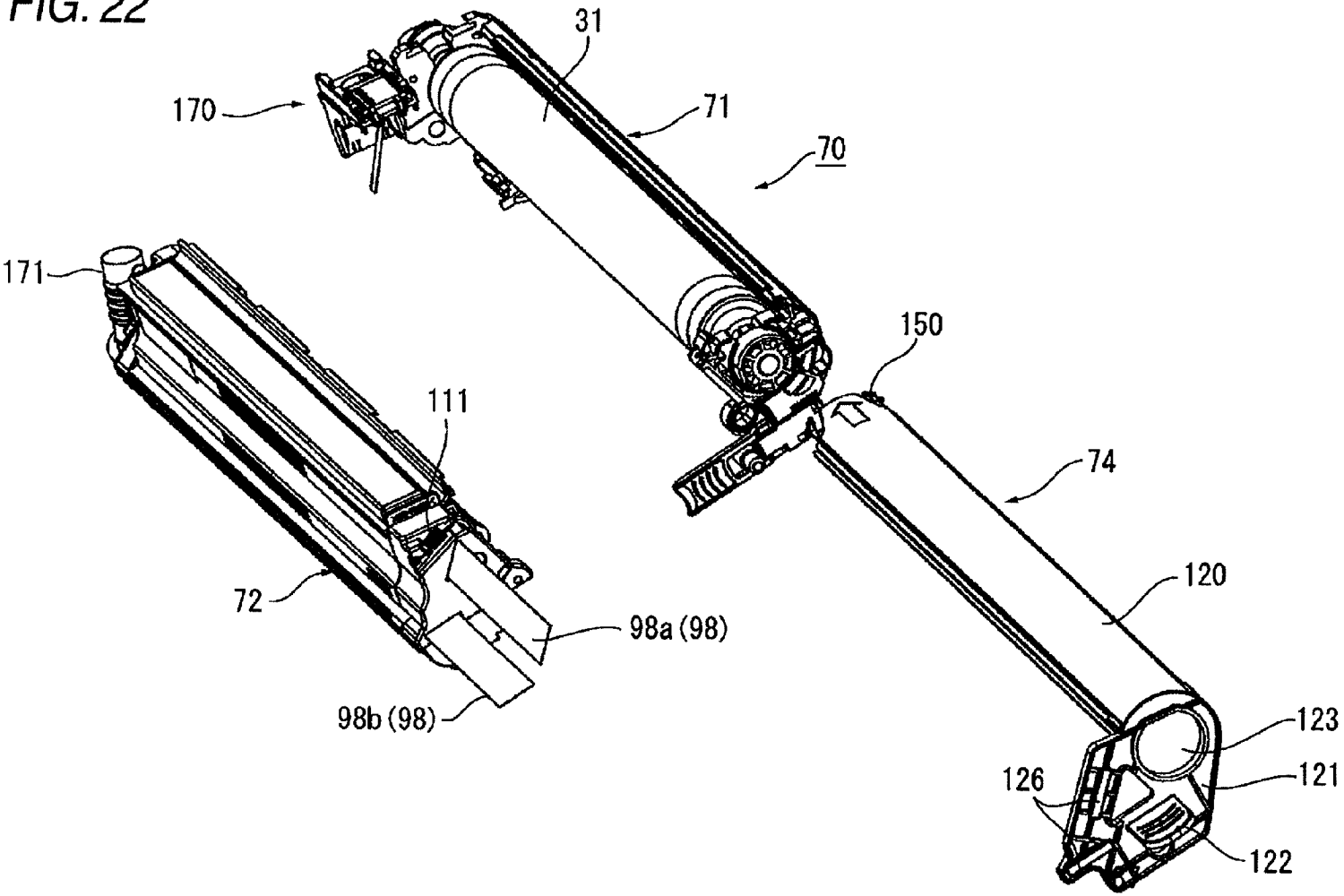
FIG. 22 is an exploded perspective view showing the image forming assembly being used in Exemplary Embodiment 2.

FIGS. 20 to 22 show the overall configuration of an image forming assembly according to Exemplary Embodiment 2.

In the figures, the image forming assembly 70 is approximately similar to that according to Exemplary Embodiment 1 but is different from that according to Exemplary Embodiment 1 in that the tips of the hermetic seals 98 (98*a* and 98*b*) of the developing assembly 72 are adhered to the fixed portion 126 of the bent member 121 of the protection cover 74 by an adhesive, for example.

Components similar to those according to Exemplary Embodiment 1 are designated by similar numerals, and the detailed descriptions thereof are omitted.

Figure 23:
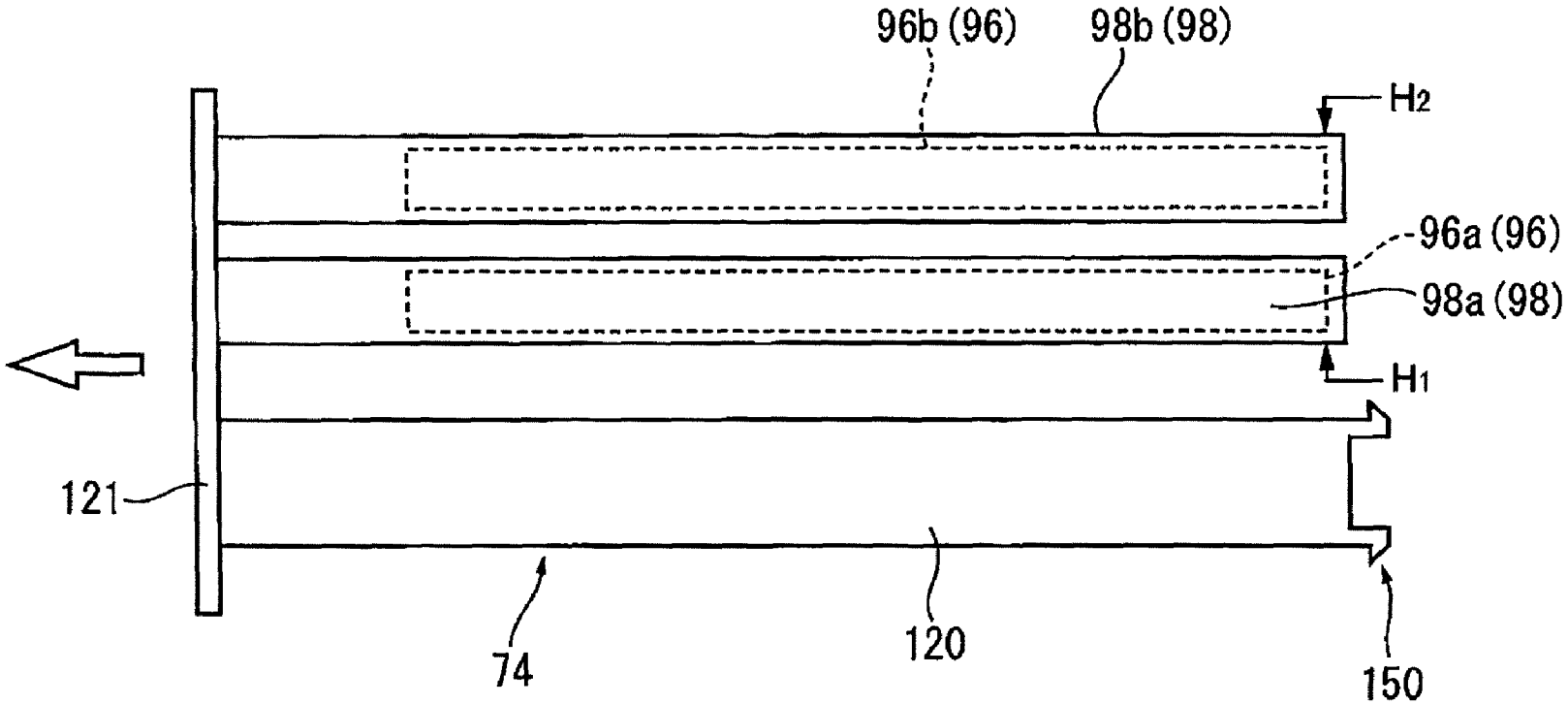
FIG. 23 is an explanatory view showing the relationship between the protection cover and the hermetic seals being used in Exemplary Embodiment 2.

Hence, in this exemplary embodiment, as shown in FIG. 23, after the image forming assembly 70 is mounted on the receiving section U (see FIG. 18) of the housing 21, the protection cover 74 should only be extracted in a direction opposite to the mounting direction of the image forming assembly 70.

In this state, by the extraction of the protection cover 74, the photoreceptor 31 of the image forming assembly 70 can be set in an exposed state in which imaging is possible, and the hermetic seals 98 (98*a* and 98*b*) can be removed from the developing assembly 72 when the protection cover 74 is removed.

At this time, during the work for removing the protection cover 74, large peeling forces $H_1$ and $H_2$ are applied to the multiple hermetic seals 98 (98*a* and 98*b*), respectively, at the start of peeling the seals.

Figure 24A:
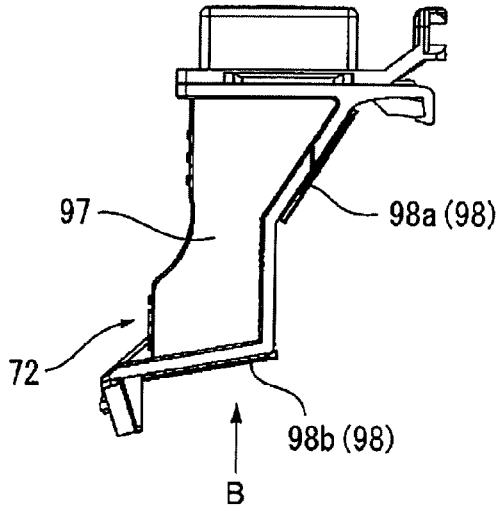
FIG. 24A is an explanatory view showing the installation state of the hermetic seals in the developing assembly.
Figure 24B:
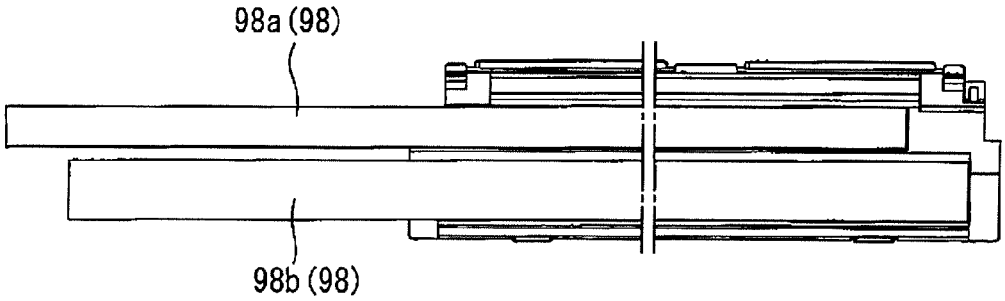
FIG. 24B is a view seen from arrow B of FIG. 24A.
Figure 25A:
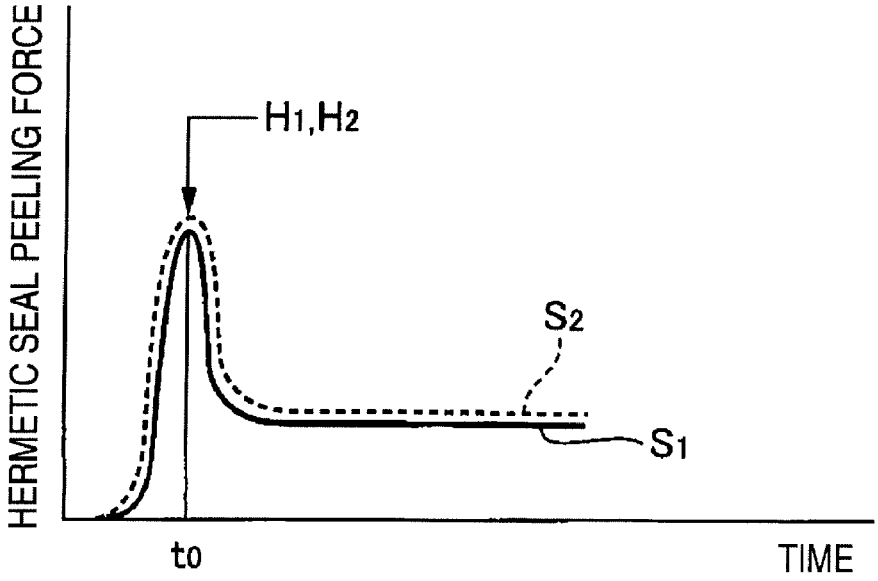
FIG. 25A is an explanatory view showing an example of the change in force for peeling multiple hermetic seals with respect to time.

In this state, assuming that the timings for staring the peeling of the multiple hermetic seals 98 (98*a* and 98*b*) are the same as shown in FIGS. 24A and 24B, the peak points of the peeling forces $H_1$ and $H_2$ exerted when the peeling of the multiple hermetic seals 98 (98*a* and 98*b*) is started overlap each other as shown in FIG. 25A. Because of this overlap, the force for extracting the protection cover 74 becomes large.

Figure 24C:
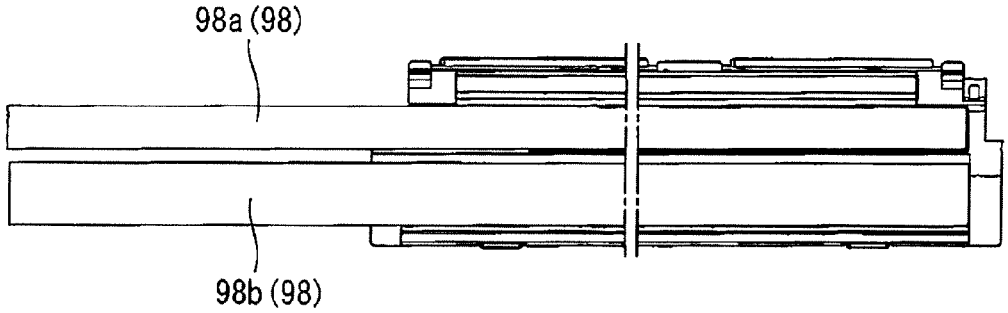
FIG. 24C is a view seen from arrow B of FIG. 24A, showing a mode in which the installation positions of the hermetic seals are changed.
Figure 25B:
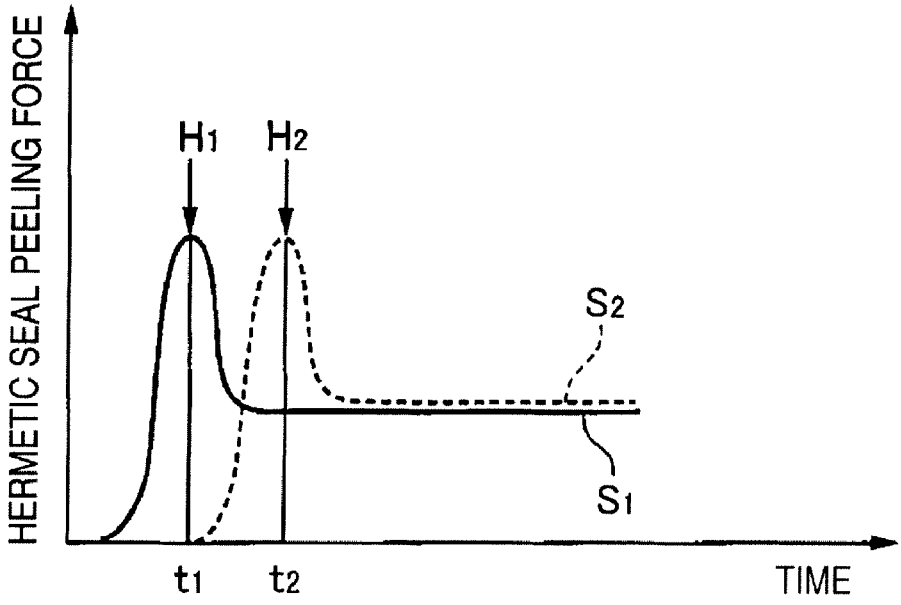
FIG. 25B is an explanatory view showing another example of the change in force for peeling multiple hermetic seals with respect to time.

On the other hand, in the case that the timings for staring the peeling of the multiple hermetic seals 98 (98*a* and 98*b*) are different as shown in FIGS. 24A and 24C, the peak points of the peeling forces $H_1$ and $H_2$ exerted when the peeling of the multiple hermetic seals 98 (98*a* and 98*b*) is started become different as shown in FIG. 25B. Because of this difference, the force for extracting the protection cover 74 is reduced.

In FIGS. 25A and 25B, $S_1$ and $S_2$ correspond to the hermetic seals 98*a* and 98*b*.

Figure 26A:
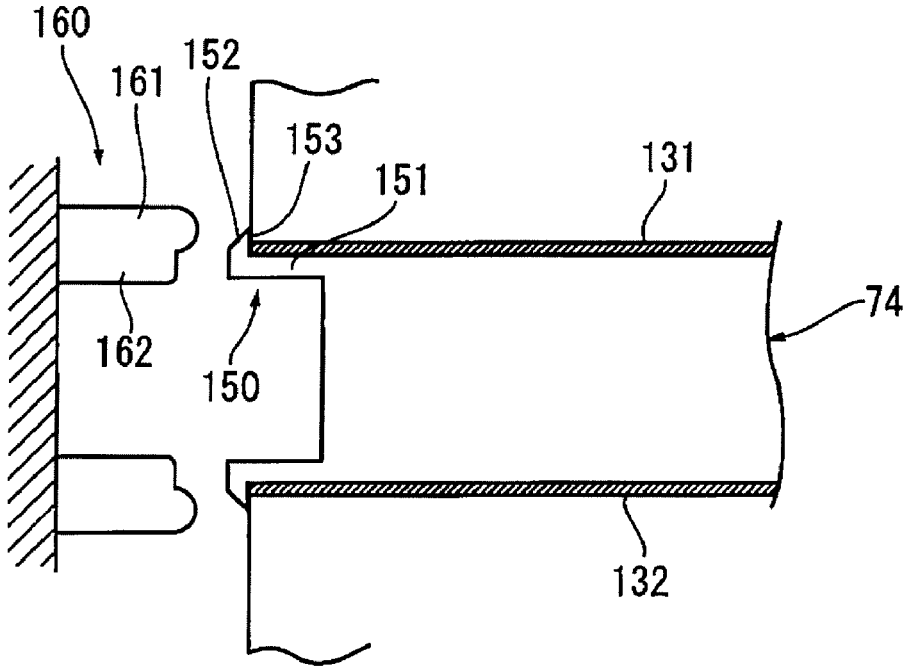
FIG. 26A is an explanatory view showing an example of the constraint-releasing mechanism of the protection cover being used in Exemplary Embodiment 2.
Figure 26B:
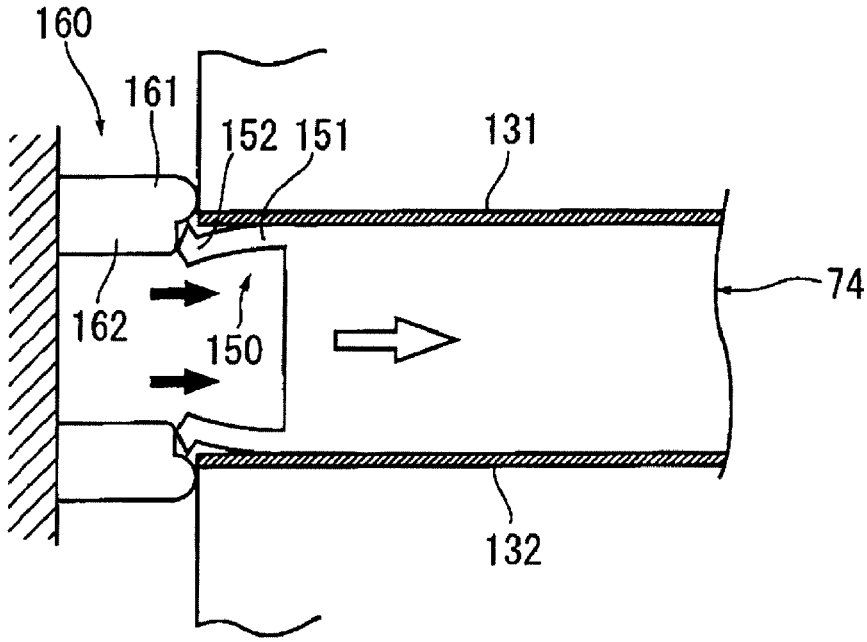

Furthermore, in a mode in which the timings for staring the peeling of the multiple hermetic seals 98 (98*a* and 98*b*) are the same or different, it is preferable that the constraint-releasing mechanism 160 for releasing the constraining mechanism 150 of the protection cover 74 (as in Exemplary Embodiment 1) should be ingeniously modified, for example, as shown in FIGS. 26A and 26B so that, in addition to the releasing protruding pieces 161, push-back protruding pieces 162 for pushing back the elastic protruding pieces 151, the constrained state of which has been released by the releasing protruding pieces 161, are formed, whereby, as the constrained state of the constraining mechanism 150 is released by the constraint-releasing mechanism 160, a push-back force is applied to the protection cover 74 in the extraction direction thereof.

With the exemplary embodiment, it is preferable that the push-back force is applied to the protection cover 74 by the constraint-releasing operation by the constraint-releasing mechanism 160, whereby an initial push-back amount can be applied to the protection cover 74. Hence, this configuration is preferable in that the peeling forces applied when the peeling of the hermetic seals 98 (98*a* and 98*b*) is started are reduced.

What is claimed is:

1. An image forming assembly, which is detachably mounted on a receiving section provided beforehand in a housing of an image forming apparatus and forms an image on a transfer medium, the image forming assembly comprising:

a photoreceptor assembly that comprises:

a photoreceptor, and an accommodating container that accommodates at least the photoreceptor and holds the photoreceptor with a part of the photoreceptor being exposed;

a developing assembly that comprises:

a developing member, and a developer container that accommodates at least the developer member and holds the developing member so as to position the developing member at a portion opposed to the photoreceptor;

a connecting mechanism that connects the photoreceptor assembly to the developing assembly so that a distance between the photoreceptor and the developing member is changeable;

a protection member that covers and protects the exposed portion of the photoreceptor; and guide members that are respectively provided on the accommodating container and the developer container, and that detachably guide the protection member with the protection member lying astride the two assemblies, wherein when the protection member is in a constrained state where the protection member covers the photoreceptor, the developing member and the photoreceptor are positioned away from each other.

2. The image forming assembly according to claim 1, wherein the guide members are provided on the accommodating container and the developer container, extend in an attaching/detaching direction of the image forming assembly and slidably guide the protection member.

3. The image forming assembly according to claim 1, further comprising:

a constraining mechanism that constrains a movement of the protection member with respect to the guide members.

4. The image forming assembly according to claim 1, further comprising:

a position adjusting member that maintains a positional relationship between the developing member and the photoreceptor constant during image forming.

5. The image forming assembly according to claim 1, wherein the developing assembly comprises, in the developer container, a developer accommodating chamber that accommodates a developer, and an initial developer storing chamber that is adjacent to the developer accommodating chamber via at least one opening section and stores an initial developer before use, and when the developing assembly is not used, the at least one opening section between the initial developer storing chamber and the developer accommodating chamber is hermetically sealed with at least one hermetic sealing member, and the at least one hermetic sealing member is fixed to the protection member so as to be movable together with the protection member.

6. The image forming assembly according to claim 5, wherein when the protection member is removed from the guide members, the at least one hermetic sealing member is moved together with the protection member so that the opening section between the initial developer storing chamber and the developer accommodating chamber is opened and the initial developer is supplied into the developer accommodating chamber.

7. The image forming assembly according to claim 5, further comprising:

a constraining mechanism that constrains a movement of the protection member with respect to the guide members, wherein when the constrained state of the protection member by the constraining mechanism is released, the protection member starts moving along the guide members, and thereby the hermetic sealing state by the at least one hermetic sealing member is released.

8. The image forming assembly according to claim 5, wherein the at least one opening section is a plurality of opening sections, and the at least one hermetic sealing member is a plurality of hermetic sealing members, which are provided for the plurality of opening sections.

9. The image forming assembly according to claim 8, wherein releasing operations of the hermetic sealing states by the plurality of the hermetic sealing members start at different times in accordance with a removal of the protection member.

10. An image forming apparatus comprising:

a housing that has a receiving section; and the image forming assembly according to claim 1 detachably mounted on the receiving section.

11. The image forming apparatus according to claim 10, wherein the image forming assembly comprises a constraining mechanism that constrains a movement of the protection member with respect to the guide members, and the housing is provided with a constraint-releasing mechanism that is capable of releasing the constrained state of the protection member by the constraining mechanism when the image forming assembly is mounted on the receiving section.

12. The image forming apparatus according to claim 10, wherein the housing has a door that is opened and closed when the image forming assembly is mounted on and dismounted from the receiving section, the protection member is removable from the image forming assembly when the image forming assembly is mounted on the receiving section of the housing, and prevents the door of the housing from being closed in a state that the protection member is not removed from the image forming assembly.

13. An image forming assembly, which is detachably mounted on a receiving section provided beforehand in a housing of an image forming apparatus and forms an image on a transfer medium, the image forming assembly comprising:

a photoreceptor assembly that comprises:

a photoreceptor, and an accommodating container that accommodates the photoreceptor and has an opening, a part of the photoreceptor being exposed via the opening;

a developing assembly that comprises;

a developing member, and a developer container that accommodates the developing member and the developing member is disposed opposed to the photoreceptor;

a protection member that covers the exposed portion of the photoreceptor;

guide members that are respectively provided on the accommodating container and the developer container, and that detachably guide the protection member with the protection member lying astride the photoreceptor assembly and the developing assembly; and a positioning portion that formed on an end side of the image forming assembly, wherein the protection member comprising an end cover that covers the end side of the image forming assembly, the end cover comprising a positioned portion that engages with the positioning portion so that the protection member is positioned by the positioning portion.

14. The imaging forming assembly according to claim 13, wherein when the protection member is in a constrained state where the protection member covers the photoreceptor, the developing member and the photoreceptor are positioned away from each other.

* * * * *